US006368779B1

(12) United States Patent
Lynch et al.

(10) Patent No.: US 6,368,779 B1
(45) Date of Patent: Apr. 9, 2002

(54) HIGH SPEED PHOTOTHERMOGRAPHIC MATERIALS AND METHODS OF MAKING AND USING SAME

(75) Inventors: Doreen C. Lynch, Afton; Sharon M. Simpson, Lake Elmo; Steven M. Shor, Woodbury; Brian C. Willett, Stillwater; Chaofeng Zou, Maplewood, all of MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/667,748

(22) Filed: Sep. 21, 2000

(51) Int. Cl.[7] ..... G03C 1/498; G03C 1/34; G03C 1/08; G03C 1/74

(52) U.S. Cl. ..... 430/350; 430/510; 430/517; 430/527; 430/600; 430/603; 430/611; 430/613; 430/944

(58) Field of Search ..... 430/619, 617, 430/510, 517, 527, 600, 350, 603, 611, 613, 944

(56) References Cited

U.S. PATENT DOCUMENTS

| | | | |
|---|---|---|---|
| 4,036,650 | A | 7/1977 | Hasegawa et al. |
| 4,207,108 | A | 6/1980 | Hiller |
| 4,213,784 | A | 7/1980 | Ikenoue et al. |
| 4,469,783 | A | 9/1984 | Jywabara et al. |
| 4,749,646 | A | 6/1988 | Herz et al. |
| 4,810,626 | A | 3/1989 | Burgmaier et al. |
| 5,015,567 | A | 5/1991 | Suga et al. |
| 5,210,002 | A | 5/1993 | Adin |
| 5,834,176 | A | 11/1998 | Ishikawa et al. |
| 5,843,632 | A | 12/1998 | Eshelman et al. |
| 5,891,615 | A | 4/1999 | Winslow et al. |
| 5,922,529 | A | 7/1999 | Tsuzuki et al. |
| 6,100,022 | A | 8/2000 | Inoue et al. |

FOREIGN PATENT DOCUMENTS

| | | |
|---|---|---|
| JP | 11-202444 | 7/1999 |

*Primary Examiner*—Thorl Chea
(74) *Attorney, Agent, or Firm*—J. Lanny Tucker

(57) ABSTRACT

Photothermographic materials have increased photospeed provided by certain organic solvent-soluble thiourea compounds that can be represented by the following Structure I, II, or III:

I

II

III wherein in Structure I, $R_1$, $R_2$, $R_3$ and $R_4$ are independently alkyl, cycloalkyl, allyl, alkenyl, alkynyl, aryl or heterocyclic groups, or $R_1$ and $R_2$ taken together, $R_3$ and $R_4$ taken together, $R_1$ and $R_3$ taken together or $R_2$ and $R_4$ taken together, can form a 5- to 7-membered heterocyclic ring, in Structure II, $R_1$, $R_2$, $R_3$, $R_4$ and $R_5$ are independently alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure III, $R_1$, $R_2$, $R_3$, $R_4$, $R_5$, and $R_6$ are independently alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group. In addition, the speed increasing compounds represented by Structure I do not require a heat activation step at 30° C. or higher temperature for at least 5 minutes and have a pKa of at least 7. Compounds of Structure I are also free of exocyclic carbon-carbon double bonds and nucleophilic groups.

27 Claims, No Drawings

HIGH SPEED PHOTOTHERMOGRAPHIC MATERIALS AND METHODS OF MAKING AND USING SAME

FIELD OF THE INVENTION

This invention relates to thermally-developable imaging materials such as photothermographic materials that exhibit high speed imaging characteristics. In particular, this invention relates to the use of certain chalcogen compounds as chemical sensitizers in photothermographic materials to provide increased photothermographic speed. This invention also relates to methods of imaging using these photothermographic materials, and to a method of making imaging formulations used in them.

BACKGROUND OF THE INVENTION

Photothermographic imaging materials that are developed with heat and without liquid development have been known in the art for many years. Such materials are used in a recording process wherein images are generated by the use of thermal energy. In direct photothermography, a visible image is formed by imagewise exposure of the photothermographic material to specific electromagnetic radiation (for example, visible, ultraviolet or infrared radiation). These materials, also known as "dry silver" materials, generally comprise a support having coated thereon: (a) photosensitive catalyst (such as silver halide) that upon such exposure provides a latent image in exposed grains that are capable of acting as catalysts for the formation of a silver image, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires an intimate physical association of these two components either prior to or during the thermal image development process so that when silver atoms $[Ag(0)]_n$, (also known as silver specks, clusters or nuclei) are generated by irradiation or light exposure of the photosensitive silver halide, those silver atoms are able to catalyze the reduction of the reducible silver ions within a catalytic sphere of influence around the silver atoms [Klosterboer, Neblette's Eighth Edition: *Imaging Processes and Materials,* Sturge, Walworth & Shepp (Eds.), Van Nostrand-Reinhold, New York, Chapter 9, pages 279–291, 1989]. It has long been understood that silver atoms act as a catalyst for the reduction of silver ions, and that the photosensitive silver halide can be placed into catalytic proximity with the non-photosensitive source of reducible silver ions in a number of different ways (see, for example, Research Disclosure, June 1978, Item No. 17029). Other photosensitive materials, such as titanium dioxide, cadmium sulfide, and zinc oxide have been reported to be useful in place of silver halide as photocatalysts in photothermographic materials [see, for example, J. W. Shepard, *J. Appl. Photog. Eng.* 1982, 8(5), 210–212; S. Shigeo, et al., *Nippon Kagaku Kaishi,* 1994, 11, 992–997; and FR 2, 254,047 (Robillard)].

The photosensitive silver halide may be made "in situ" for example by mixing an organic or inorganic halide-containing source with a source of reducible silver ions to achieve partial metathesis and thus causing the in-situ formation of silver halide (AgX) grains on the surface of the silver halide grains [see, for example, U.S. Pat. No. 3,457,075 (Morgan et al.)].

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and photothermographic material. The preformed silver halide grains may be introduced prior to and be present during the formation of the silver soap. Co-precipitation of the silver halide and reducible silver source provides a more intimate mixture of the two materials [see, for example, U.S. Pat. No. 3,839,049 (Simons)] Alternatively, the preformed silver halide grains may be added to and physically mixed with the reducible silver salt.

The non-photosensitive source of reducible silver ions is a material that contains silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids." Silver salts of other organic acids or other organic compounds, such as silver imidazoles, silver benzotriazoles, silver benzotetrazoles, silver tetrazoles, silver benzothiazoles and silver acetylides, have been proposed. U.S. Pat. No. 4,260,677 (Winslow et al.) discloses the use of complexes of various non-photosensitive inorganic or organic silver salts.

In photothermographic emulsions, exposure of the photographic silver halide to light produces small clusters of silver atoms $[Ag(0)]_n$. The imagewise distribution of these clusters, known in the art as a latent image, is generally not visible by ordinary means. Thus, the photosensitive emulsion must be further developed to produce a visible image. This is accomplished by the reduction of silver ions that are in catalytic proximity to silver halide grains bearing the clusters of silver atoms (that is, the latent image). This produces a black-and-white image. The non-photosensitive silver source is reduced to form the visible black-and-white negative image while much of the silver halide generally remains as silver halide and is not reduced.

In photothermographic materials, the reducing agent for silver ions of the light-insensitive reducible silver salt, often referred to as a "developer," may be any compound that, in the presence of the latent image, can reduce silver ions to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer.

Differences Between Photothermography and Photography

The imaging arts have long recognized that the field of photothermography is clearly distinct from that of photography. Photothermographic materials differ significantly from conventional silver halide photographic materials that require processing with aqueous solutions to provide visible images.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the photosensitive silver halide serves as a catalyst for the physical development of the non-photosensitive source of reducible silver ions. In contrast, conventional wet-processed, black-and-white photographic materials use only one form of silver that, upon chemical development, is itself converted into the silver image, or that upon physical development requires addition of an external silver source. Thus, photothermographic materials require an amount of silver halide per unit area that is only a fraction of that used in conventional wet-processed photographic materials.

In photothermographic materials, all of the "chemistry" for imaging is incorporated within the material itself. For example, they include a developer (that is, a reducing agent for the reducible silver ions) while conventional photographic materials usually do not. Even in so-called instant photography, the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in an aqueous fixing step).

In photothermographic materials, the binder is capable of wide variation and number of binders (both hydrophilic and hydrophobic) are useful. In contrast, conventional photographic materials are limited almost exclusively to hydrophilic colloidal binders such as gelatin.

Because photothermographic materials require dry thermal processing, they pose different considerations and present distinctly different problems in manufacture and use, compared to conventional, wet-processed silver halide materials. In addition, the effects of additives (for example, stabilizers, antifoggants, speed enhancers, sensitizers and supersensitizers) that are intended to have a direct effect upon the imaging process, can vary depending upon whether they have been incorporated into a photothermographic material or a photographic material. For example, it is not uncommon for an antifoggant for a silver halide photographic material to produce various types of fog when incorporated into photothermographic materials. Furthermore, certain stabilizers are required in photothermographic materials that have quite distinctive properties (for example tribromomethyl substituted stabilizer compounds).

The benefits of using such additives in one type of material (for example photographic materials) are not predictive of whether such additives will provide the same or another desired benefit in photothermographic materials. Additives that have one effect in conventional silver halide photography may behave quite differently in photothermographic materials where the underlying chemistry is so much more complex. For example, it is not uncommon for a photographic antifoggant useful in conventional photographic materials to cause various types of fog when incorporated into photothermographic materials. Furthermore, some supersensitizers that are effective in photographic materials are inactive in photothermographic materials.

These and other distinctions between photothermographic and photographic materials are described in *Imaging Processes and Materials* (*Neblette's Eighth Edition*), noted above, *Unconventional Imaging Processes,* E. Brinckman et al. (Eds.), The Focal Press, London and New York, 1978, pages 74–75, and in Zou et al., *J. Imaging Sci. Technol.* 1996, 40, pages 94–103.

Problem to be Solved

One of the challenges in the use of photothermographic materials is attaining sufficient photothermographic speed in materials that are also compatible with conventional imaging sources.

Each of the pure photographic silver halides (silver chloride, silver bromide and silver iodide) has its own natural response, in both wavelength and speed, to radiation within the UV, near UV and blue regions of the electromagnetic spectrum. Silver chloride and silver bromide are used predominantly. Mixtures of silver halides (for example, silver bromochloroiodide, silver chloroiodide, silver chlorobromide and silver iodobromide) also have sensitivities to different regions of the electromagnetic spectrum within the UV and blue regions. Thus, silver halide grains, when composed of only silver and halogen atoms would have defined levels of sensitivity depending upon the levels of specific halogens, morphology (shape and structure of the crystals or grains) and other artifacts (for example, crystal defects, crystal stresses and dopants) that may or may not have been readily controlled by skilled workers in the art over the years. Some of these features have been purposely introduced to affect emulsion sensitometry.

The efforts to influence silver halide grain speed in conventional wet-processed silver halide emulsions generally fall within the investigation of crystal composition, morphology or structure (all briefly described above), or the use of dopants, spectral sensitizers, supersensitizers, reduction sensitizers, and chemical sensitizers (particularly sulfur sensitizers).

Spectral sensitization is the addition of a compound (usually a dye) to silver halide grains that absorbs radiation at wavelengths (UV, visible or IR) other than those to which the silver halide is naturally sensitive, or that absorb radiation more efficiently than silver halide (even within the regions of silver halide natural sensitivity). It is generally recognized that spectral sensitizers extend the responses of photosensitive silver halide to longer wavelengths. After absorption of the radiation, these compounds transfer energy or electrons to the silver halide grains to cause the necessary local photoinduced reduction of silver (I) to silver (0).

Supersensitization is a process whereby the speed of spectrally sensitized silver halide is increased by the addition of still another compound that may or may not be a dye. This is not merely an additive effect of the two compounds (spectral sensitizer and supersensitizer).

Reduction sensitization is a type of chemical sensitization (described in more detail in the following paragraphs) in which other chemical species (not sulfur-containing) are deposited onto or reacted with the silver halide grains during grain growth and finishing. Compounds used for this purpose act as reducing agents on the silver halide grains and include, but are not limited to, stannous chloride, hydrazine, ethanolamine and thioureaoxide.

Chemical sensitization (generally sulfur-sensitization) is a process during or after silver halide crystal formation in which sensitizing $Ag_2S$ specks are introduced onto the individual silver halide grains. For example, silver sulfide specks can be introduced by direct reaction of sulfur-contributing compounds with the silver halide during various stages of grain growth or even after completion of silver halide grain growth. These specks usually function as shallow electron traps for the preferential formation of a latent image center. Other chalcogens (Se and Te) function similarly. The presence of these specks increases the speed or sensitivity of the resulting silver halide grains to radiation. Sulfur-contributing compounds useful for this purpose include thiosulfates and various thioureas (such as sodium thiosulfate, allyl thiourea, thiourea, triethyl thiourea and 1,1'-diphenyl-2-thiourea) as described for example, by Sheppard et al., *J. Franklin Inst.,* 1923, 196, 653 and 673, Mees and James, *The Theory of the Photographic Process,* $4^{th}$ Edition, 1977, pages 152–3, and Tani, T., *Photographic Sensitivity: Theory and Mechanisms,* Oxford University Press, N.Y., 1995, p. 167–176.

Another method of chemical sensitization is achieved by oxidative decomposition of a sulfur-containing spectral sensitizing dye in a photothermographic emulsion as described in U.S. Pat. No. 5,891,615 (Winslow et al.).

Chemical sensitization to increase photospeed has been achieved by treating the silver halide grains with gold-containing ions such as tetrachloroaurate (III) or dithiocyanoaurate (I). Preferably, the gold compounds are added in the later stages of silver halide grain formation such as during ripening. Platinum and palladium are also known to have similar effects. In comparison, compounds of iridium, rhodium, and ruthenium are generally used to control contrast or high intensity reciprocity effects rather than to increase speed.

It is well known that the various speed enhancing means just described can be used in combination as the situation requires.

As noted above, in photothermographic emulsions, the photosensitive silver halide must be in catalytic proximity to the non-photosensitive source of reducible silver ions. Because of the different emulsion making procedures and chemical environment of photothermographic emulsions, the effects achieved by compounds (such as chemical sensitizers) in conventional photographic emulsions are not necessarily possible in photothermographic emulsions.

For example, in photothermographic emulsions, two types of chemical sensitization have been used to increase speed: (a) chemical sensitization of preformed silver halide grains that are then mixed into the solution containing reducible silver ions in some manner, and (b) chemical sensitization of preformed silver halide grains when they are already in intimate contact with the reducible silver ions.

In the first approach (a), many of the traditional methods (used for photographic emulsions) can be used, but for the second approach (b), quite specific methods and unique compounds are often needed. Regardless of which approach is used, there is considerable difficulty in attaining additional speed while maintaining low fog ($D_{min}$).

It is generally thought that a mechanism involving thione-thiol tautomerization of thioureas is significant in achieving efficient sulfur sensitization in photographic materials. Tetrasubstituted thioureas have been found to be either inert or poor sensitizers (see for example, Zavlin et al., IS&T's $48^{th}$ Annual Conference Papers, May 7–11 1995 Wash. D.C., pp. 156–6).

However, U.S. Pat. No. 4,810,626 (Burgmaier et al.) describes tetrasubstituted thiourea compounds that can function as chemical sensitizing agents in conventional silver halide photography, but the sensitizing effect is limited to compounds substituted with at least one nucleophilic group, such as carboxy (—COOH), sulfo (—$SO_2H$), sulfonic (—$SO_3H$), hydroxamic (—NHOH), mercapto (—SH), sulfonamido (—$SO_2NH$—) and primary and secondary amine groups.

The use of certain chalcogen compounds in photothermographic systems is also described in the art, but such compounds have exhibited limited effectiveness. For example, U.S. Pat. No. 4,036,650 (Kobayashi et al.) describes a heat developable photosensitive material that includes a compound having a —C(═S)—S— moiety. U.S. Pat. No. 4,213,784 (Ikenoue et al.) describes a process for producing a thermally developable, light sensitive composition containing an organic silver salt and a light sensitive silver halide in the presence of a heterocyclic sulfur containing compound. The sulfur-containing compounds described in this patent include both inorganic and organic compounds, and substituted organic thiourea compounds having a (—CS—NH—) moiety are preferred. However, a heating step (30–70° C.) for about 5–30 minutes is required for such compounds to be used in this manner. Still other speed increasing compounds are described in U.S. Pat. No. 4,207,108 (Hiller) as "thione speed increasing addendum" that can be a heterocyclic compound having a —S—C(═S)—NR— moiety.

Certain 1,1',3,3'-tetrasubstituted thioureas and selenoureas are said to enhance the sensitivity of photothermographic compositions in U.S. Pat. No. 5,843,632 (Eshelman et al.). These compounds must comprise at least one thiourea substituent that contains an acidic moiety (such as a carboxylic acid) so they can be used in hydrophilic emulsions. Such chemical sensitizers must be dissolved in an aqueous medium and then mixed with silver halide grains that are suspended in a non-aqueous medium. These compounds are useful in a temperature range of from 30 to 90° C., the silver halide grains are grown in organic solvents and the noted thioureas are dissolved in aqueous solutions for addition to the imaging formulation.

Photothermographic materials are constantly being redesigned to meet ever-increasing performance, storage, and manufacturing demands raised by customers, regulators, and manufacturers. One of these is for increased photospeed without a significant increase in $D_{min}$ (fog) or a loss in $D_{max}$. The present invention describes our discovery that the use of certain thiourea compounds as chemical sensitizers provides photothermographic materials having increased photospeed without a significant increase in $D_{min}$.

SUMMARY OF THE INVENTION

The present invention provides the desired benefits with a photothermographic material comprising a support having thereon one or more layers comprising a binder and in reactive association:

a. a photocatalyst, b. a non-photosensitive source of reducible silver ions, c. a reducing composition for said reducible silver ions, and d. an organic solvent-soluble thiourea speed increasing compound represented by the following Structure I, II, or III:

I

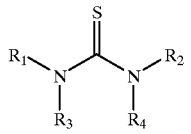

II

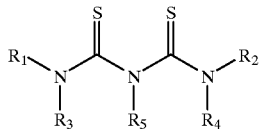

III

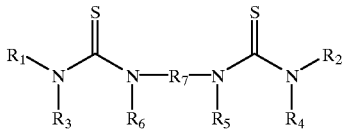

wherein:

in Structure I, $R_1$, $R_2$, $R_3$ and $R_4$ are independently alkyl, cycloalkyl, alkenyl, alkynyl, aryl, or heterocyclic groups, or $R_1$ and $R_2$ taken together, $R_3$ and $R_4$ taken together, $R_1$ and $R_3$ taken together or $R_2$ and $R_4$ taken together, can form a 5- to 7-membered heterocyclic ring, and in Structure II, $R_1$, $R_2$, $R_3$, $R_4$ and $R_5$ are independently alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, in Structure III, $R_1$, $R_2$, $R_3$, $R_4$, $R_5$, and $R_6$ are independently alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, provided that the speed increasing compound represented by Structure I does not require a heat activation step at 30° C. or higher temperatures for at least 5 minutes, has a pKa of at least 7, and is free of exocyclic carbon-carbon double bonds and nucleophilic groups.

In an additional embodiment of this invention, a method for preparing a photothermographic emulsion comprises:

A) providing a photothermographic emulsion comprising a photocatalyst and a non-photosensitive source of reducible silver ions, B) positioning an organic solvent-soluble thiourea speed increasing compound represented by the Structure I, or II, or III noted above on or around the photocatalyst, and C) when a speed increasing compound represented by Structure I is present, chemically sensitizing the photothermographic emulsion at a temperature below 30° C.

Further, a method of this invention for forming a visible image comprises:

A) imagewise exposing the photothermographic material described above to electromagnetic radiation to form a latent image, and B) simultaneously or sequentially, heating the exposed photothermographic material to develop the latent image into a visible image.

In some embodiments of this invention to provide an image, the photothermographic materials have a transparent support and the method of this invention further comprises:

C) positioning the exposed and heat-developed photothermographic material with a visible image therein between a source of imaging radiation and an imageable material that is sensitive to the imaging radiation, and D) thereafter exposing the imageable material to the imaging radiation through the visible image in the exposed and heat developed photothermographic material to provide a visible image in the imageable material.

The chemical sensitizing thiourea compounds described for use in the photothermographic materials of this invention have a number of useful properties. They provide a desired increase in photospeed without a significant increase in $D_{min}$ (fog). The thiourea compounds of Structures I, II, and III can be used effectively even if the silver halide and reducible silver ions are in intimate contact when speed enhancement occurs. The advantages of this invention can be more readily seen from the results provided in the Examples below.

DETAILED DESCRIPTION OF THE INVENTION

The photothermographic materials of this invention can be used, for example, in conventional black-and-white photothermography, in electronically generated black-and-white hardcopy recording, in the graphic arts area (for example imagesetting and phototypesetting), in proofing, in microfilm applications and in radiographic imaging. Furthermore, the absorbance of these photothermographic materials between 350 and 450 nm can be desirably low and permit their use in graphic arts applications such as contact printing, proofing, and duplicating.

In the photothermographic materials of this invention, the components needed for imaging can be in one or more layers. The layer(s) that contain the photosensitive photocatalyst (such as photosensitive silver halide) or non-photosensitive source of reducible silver ions, or both, are referred to herein as emulsion layer(s). The photocatalyst and the non-photosensitive source of reducible silver ions are in catalytic proximity (or reactive association) and preferably are in the same layer.

Various layers are usually disposed on the "backside" (non-emulsion side) of the materials, including antihalation layer(s), protective layers, antistatic layers, conducting layers and transport enabling layers.

Various layers are also usually disposed on the "frontside" or emulsion side of the support, including protective topcoat layers, primer layers, interlayers, opacifying layers, antistatic layers, antihalation layers, auxiliary layers and others readily apparent to one skilled in the art.

The present invention also provides a process for the formation of a visible image (usually black-and-white image) by first exposing to electromagnetic radiation and thereafter heating the inventive photothermographic material. In one embodiment, the present invention provides a process comprising:

A) imagewise exposing the photothermographic material of this invention to electromagnetic radiation to which the photocatalyst (for example a photosensitive silver halide) of the material is sensitive, to generate a latent image, and B) simultaneously or sequentially, heating the exposed material to develop the latent image into a visible image.

This visible image can also be used as a mask for exposure of other photosensitive imageable materials, such as graphic arts films, proofing films, printing plates and circuit board films, that are sensitive to suitable imaging radiation (for example UV radiation). This is done by imaging an imageable material (such as a photopolymer, a diazo material, a photoresist, or a photosensitive printing plate through the exposed and heat-developed photothermographic material of this invention using steps C) and D) noted above.

When the photothermographic materials used in this invention are heat developed as described below in a substantially water-free condition after, or simultaneously with, imagewise exposure, a silver image (preferably black-and-white silver image) is obtained. The photothermographic material may be exposed in step (a) with ultraviolet, visible, infrared, or laser radiation such as from an infrared laser, a laser diode, an infrared laser diode, a light emitting screen, a CRT tube, a light emitting diode and other sources readily apparent to one skilled in the art.

In the descriptions of the photothermographic materials of the present invention, "a" or "an" component refers to "at least one" of that component. For example, the thiourea speed-increasing compounds described herein can be used individually or in mixtures.

Heating in a substantially water-free condition as used herein, means heating at a temperature of from about 50° to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process,* Fourth Edition, Macmillan 1977, page 374.

Definitions

As used herein:

"Photothermographic material(s)" means a construction comprising at least one photothermographic emulsion layer or a "two trip" photothermographic set of layers (the "two-trip" coating where the silver halide and the source of reducible silver ions are in one layer and the other essential components or desirable additives are distributed as desired in an adjacent coating layer) and any supports, topcoat layers, image-receiving layers, blocking layers, antihalation layers, subbing or priming layers. These materials also include multi-layer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer" or "photothermographic emulsion layer" means a layer of a photothermographic material that contains the photosensitive silver halide and/or non-photosensitive source of reducible silver ions. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 750 nm.

"Short wavelength visible region of the spectrum" refers to that region of the spectrum of from about 400 nm to about 450 nm.

"Red region of the spectrum" refers to that region of the spectrum of from about 600 nm to about 750 nm.

"Infrared region of the spectrum" refers to that region of the spectrum of from about 750 nm to about 1400 nm.

"Exocyclic double bond" is understood to refer to a carbon-carbon double bond connected to and hence external to, a ring structure (that is a thiourea ring structure). In contrast, carbon-carbon double bonds that form part of a ring structure are known as "endocyclic double bonds."

"Non-photosensitive" means not intentionally light sensitive.

"Transparent" means capable of transmitting visible light or imaging radiation without appreciable scattering or absorption.

As is well understood in this area, for the thioureas defined in Structures I, II, and III substitution is not only tolerated, but is often advisable and substitution is anticipated on the compounds used in the present invention.

For the compounds disclosed herein, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where there is a benzene ring structure shown substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy and the like. For example, alkyl group includes ether groups (e.g., $CH_3$—$CH_2$—$CH_2$—O—$CH_2$—), haloalkyls, nitroalkyls, carboxyalkyls, hydroxyalkyls, sulfoalkyls, and others readily apparent to one skilled in the art. Substituents that adversely react with other active ingredients, such as very strongly electrophilic or oxidizing substituents, would of course be excluded by the ordinarily skilled artisan as not being inert or harmless.

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide and others readily apparent to one skilled in the art. Mixtures of silver halides can also be used in any suitable proportion. Silver bromide and silver bromoiodide are more preferred, the latter silver halide including up to 10 mol % silver iodide.

The shape of the photosensitive silver halide grains used in the present invention is in no way limited. The silver halide grains may have any crystalline habit including, but not limited to, cubic, octahedral, tetrahedral, orthorhombic, tabular, laminar, twinned, and platelet morphologies. If desired, a mixture of these crystals may be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell-type, having a discrete core of one halide ratio, and a discrete shell of another halide ratio. Core-shell silver halide grains useful in photothermographic materials and methods of preparing these materials are described for example in U.S. Pat. No. 5,382,504 (Shor et al.). Iridium and/or copper doped core-shell and non-core-shell grains are described in U.S. Pat. No. 5,434,043 (Zou et al.), U.S. Pat. No. 5,939,249 (Zou), and EP-A-0 627 660 (Shor, et al.), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halide be preformed and prepared by an ex-situ process. The silver halide grains prepared ex-situ may then be added to and physically mixed with the nonphotosensitive source of reducible silver ions. It is more preferable to form the source of reducible silver ions in the presence of ex-situ prepared silver halide. In this process, the source of reducible silver ions, such as a long chain fatty acid silver carboxylate (commonly referred to as a silver "soap") is formed in the presence of the preformed silver halide grains. Co-precipitation of the reducible source of silver ions in the presence of silver halide provides a more intimate mixture of the two materials [see, for example, U.S. Pat. No. 3,839,049 (Simons)]. Materials of this type are often referred to as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized, such lower limit, for example being about 0.01 or 0.005 $\mu$m.

The average size of the photosensitive doped silver halide grains is expressed by the average diameter if the grains are spherical and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in The Theory of the Photographic Process, C. E. Kenneth Mees and T. H. James, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by chill setting and leaching or the emulsion can be coagulation washed [for example by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.) and U.S. Pat. No. 2,489,341 (Waller et al.) and by ultrafiltration to remove soluble salts.

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure,* June 1978, Item No. 17029, U.S. Pat. No. 3,700,458 (Lindholm) and U.S. Pat. No. 4,076,539 (Ikenoue et al.), and JP Applications 13224/74, 42529/76 and 17216/75. *Research Disclosure* is a publication of Kenneth Mason Publications Ltd., Dudley House, 12 North Street, Emsworth, Hampshire PO10 7DQ England (also available from Emsworth Design Inc., 147 West 24$^{th}$ Street, New York, N.Y. 10011).

The one or more light-sensitive silver halides used in the photothermographic materials of the present invention are preferably present in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

The advantages of this invention are provided by chemically sensitizing the silver halide(s) with certain speed increasing thiourea compounds. These compounds are organic solvent-soluble and can be generally represented by Structures I, II, and III described in detail below.

Moreover, the compounds represented by Structure I have additional properties. First of all, they have a pKa of 7 or more (preferably a pKa of at least 7.5) and are soluble primarily in organic solvents. They are free of nucleophilic groups (such as carboxy, sulfo, phospho, sulfino, hydroxamic, mercapto, sulfonamido, carbonamido, and primary and secondary amines, or the organic or inorganic salts of the noted acids) that are found on thioureas known in the art (for example, U.S. Pat. No. 4,810,626 noted above).

In addition, the thioureas of Structure I do not require a heat-activation step, which activation step would promote the formation of fog. For example, they are free of substituted carbon-carbon double bonds that are exocyclic to the thiourea, and are different from the compounds illustrated in U.S. Pat. No. 4,213,784 (noted above). Moreover, the compounds of Structure I do not require the use of a separate oxidative decomposition step for image development as required for the thioureas described in U.S. Pat. No. 5,891,615 (noted above).

When we say that the compounds represented by Structure I do not require a heat activation step, we mean a heat activation step carried out at 30° C. or higher temperature for at least 5 minutes in the process of preparing a photothermographic emulsion. By this we mean the process of adding a thiourea containing compound to the organic silver salt and silver halide and heating at from about 30° C. to about 70° C. for from about 5 minutes to about 300 minutes as described in U.S. Pat. No. 4,213,784 (noted above).

It is also desired that the compounds represented by Structure I not require the process of precipitating light-sensitive silver halide in the presence of a non-aqueous polymeric peptizer, dissolving a tetrasubstituted thiourea in water and adding it to the light-sensitive silver halide with vigorous stirring at a temperature range of from about 30° C. to about 90° C., and then combining the silver halide grains with a non-aqueous polymeric vehicle containing an oxidation-reduction image forming combination of organic silver compound and a reducing agent for the organic silver compound. Thioureas that require such an activation step may have such structural features as water solubility, an acid dissociation constant of less than 7.0, or substitution with at least one acidic group. Such compounds are described in U.S. Pat. No. 5,842,632 and are outside the scope of the present invention.

As noted above, the speed increasing thiourea compounds useful in this invention can be represented by the following Structure I, II, or III:

I

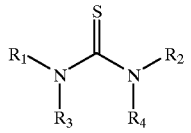

II

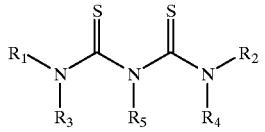

III

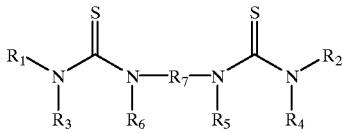

In Structure I, $R_1$, $R_2$, $R_3$, and $R_4$ independently represent substituted or unsubstituted alkyl groups (including alkylenearyl groups such as benzyl), substituted or unsubstituted aryl groups (including arylenealkyl groups), substituted or unsubstituted cycloalkyl groups, substituted or unsubstituted alkenyl groups, substituted or unsubstituted alkynyl groups and heterocyclic groups.

Useful alkyl groups are branched or linear and can have from 1 to 20 carbon atoms and preferably have from 1 to 5 carbon atoms. Most preferable alkyl groups are methyl and ethyl groups. Useful aryl groups can have from 6 to 14 carbon atoms in the carbocyclic ring. Most preferable aryl groups are phenyl or tolyl groups. Useful cycloalkyl groups can have from 5 to 14 carbon atoms in the central ring system. Most preferable cycloalkyl groups are cyclopentyl and cyclohexyl groups. Useful alkenyl and alkynyl groups are branched or linear and can have from 2 to 20 carbon atoms and preferably have from 1 to 5 carbon atoms. Most preferably the alkenyl group is an allyl group. Useful heterocyclic groups can have 5 to 10 carbon, oxygen, sulfur, and nitrogen atoms in the central ring system. Most preferable heterocyclic groups are morpholino and piperazino groups.

These various monovalent groups can be further substituted with one or more groups including but not limited to, halo groups, alkoxycarbonyl groups, hydroxy groups, alkoxy groups, cyano groups, acyl groups, acyloxy groups, carbonyloxy ester groups, sulfonic acid ester groups, alkylthio groups, dialkylamino groups, and any other group readily apparent to one skilled in the art as long as the thioureas have the requisite pKa and other properties described above.

Alternatively, $R_1$ and $R_3$ taken together, $R_2$ and $R_4$ taken together, $R_1$ and $R_2$ taken together, or $R_3$ and $R_4$ taken together, can form a substituted or unsubstituted 5- to 7-membered heterocyclic ring.

Where $R_1$ and $R_3$ are taken together or $R_2$ and $R_4$ are taken together, the heterocyclic rings can be saturated or unsaturated and can contain oxygen, nitrogen or sulfur atoms in addition to carbon atoms. Useful rings of this type include, but are not limited to, imidazole, pyrroline, pyrrolidine, thiohydantoin, pyridone, morpholine, piperazine and thiomorpholine rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), alkoxy groups, carbonyloxyester groups, halo groups, cyano groups, hydroxy groups, acyl groups, alkoxycarbonyl groups, sulfonic ester groups, alkylthio groups, carbonyl groups and other groups readily apparent to one skilled in the art as long as the thiourea compounds have the requisite pKa and other properties described above.

Where $R_1$ and $R_2$ are taken together or $R_3$ and $R_4$ are taken together, the heterocyclic rings can be saturated or unsaturated and can contain oxygen, nitrogen or sulfur atoms in addition to carbon atoms. Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5-triazine-2(1H)-thione, dihydro-2-thioxo-4,6-(1H, 3H)-pyrimidinedione, dihydro-1,3,5-triazine-2,4-(1H, 3H)-dione and hexahydrodiazepine-2-thione rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), carbonyloxyester groups, halo groups, cyano groups, hydroxy groups, acyl groups, alkoxycarbonyl groups, sulfonic ester groups, alkylthio groups, carbonyl groups, alkoxy groups and other groups readily apparent to one skilled in the art as long as the thiourea compounds have the requisite pKa and other properties described above.

In Structure II noted above, $R_1$, $R_2$, $R_3$, $R_4$ and $R_5$ have the same definitions as noted above for $R_1$, $R_2$, $R_3$ and $R_4$ in Structure I with the following differences:

The substituents on the alkyl, aryl, alkenyl, alkynyl and heterocyclic groups can also include carboxy, sulfo, phosphono and other acidic groups. $R_1$, $R_2$, $R_3$, $R_4$ and $R_5$ can independently be allyl groups.

$R_1$ and $R_3$ can be taken together, $R_2$ and $R_4$ can be taken together, $R_3$ and $R_5$ can be taken together and/or $R_4$ and $R_5$ can be taken together, to form substituted or unsubstituted 5- to 7-membered heterocyclic rings (as described above for Structure I). When those heterocyclic rings are formed from $R_1$ and $R_3$ taken together or $R_2$ and $R_4$ taken together, they are as defined above for $R_1$ and $R_3$ taken together for Structure I, but the resulting heterocyclic rings can have other substituents such as alkoxy groups, dialkylamino groups, and carboxy, sulfo, phosphono and other acidic groups. When those heterocyclic rings are formed from $R_3$ and $R_5$ taken together or $R_4$ and $R_5$ taken together, they can be substituted as described for $R_1$ and $R_3$ of Structure I except for alkoxy groups. Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3, 5,-triazine-2(1H)-thione, dihydro-2-thioxo-4,6-(1H, 3H)-pyrimidinedione, dihydro-1,3,5-triazine-2,4-(1H, 3H)-dione and hexahydrodiazepine-2-thione rings.

For Structure II, the preferred groups for $R_1$–$R_5$ are alkyl, alkenyl, alkynyl, aryl, and heterocyclic groups, more preferably alkyl, aryl, and alkenyl groups, and most preferably alkenyl groups. A preferred alkenyl group is an allyl group.

In Structure II, most preferable alkyl groups are methyl and ethyl groups. Most preferable aryl groups are phenyl or tolyl groups. Most preferable cycloalkyl groups are cyclopentyl and cyclohexyl groups. Most preferably the alkenyl group is an allyl group. Most preferable heterocyclic groups are morpholino and piperazino groups.

In Structure III noted above, $R_1$, $R_2$, $R_3$, $R_4$, $R_5$, and $R_6$ have the same definitions as noted above for $R_1$, $R_2$, $R_3$, $R_4$, and $R_5$ in Structure II described above. In addition, $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring as described above for the heterocyclic rings in Structure II.

$R_7$ is a divalent aliphatic or alicyclic linking group including but not limited to substituted or unsubstituted alkylene groups having 1 to 12 carbon atoms, substituted or unsubstituted cycloalkylene groups having 5 to 8 carbon atoms in the ring structure, substituted or unsubstituted arylene groups having 6 to 10 carbon atoms in the ring structure, substituted or unsubstituted divalent heterocyclyl groups having 5 to 10 carbon, nitrogen, oxygen, and sulfur atoms in the ring structure, or any combination of two or more of these divalent groups, or any two or more of these groups connected by ether, thioether, carbonyl, carbonamido, sulfoamido, amino, imido, thiocarbonyl, thioamide, sulfinyl, sulfonyl, or phosphinyl groups. Preferably, $R_7$ is a substituted or unsubstituted alkylene group having at least 2 carbon atoms.

Representative thiourea compounds of Structure I, II, or III include, but are not limited to, the following compounds:

I-1

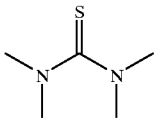

I-2

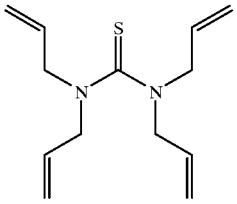

-continued

I-3

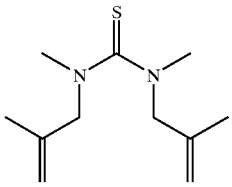

I-4

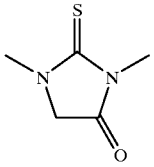

I-5

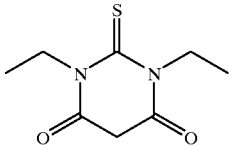

I-6

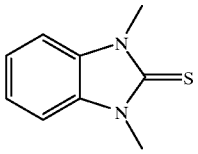

I-7

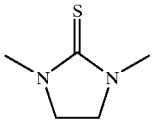

I-8

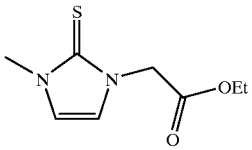

I-9

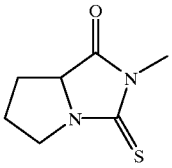

I-10

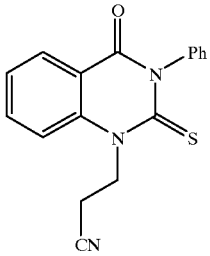

-continued
I-11
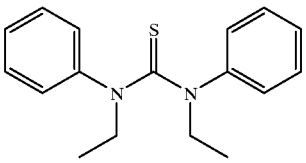
I-12
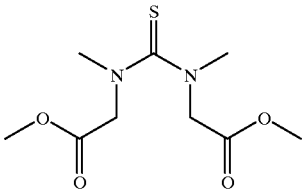
I-13
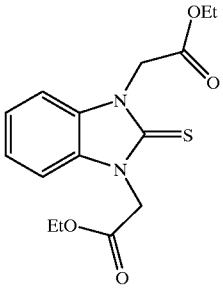
I-14
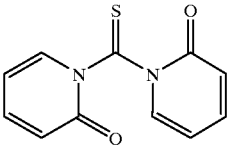
I-15
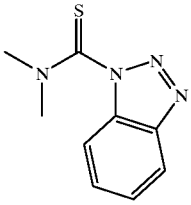
I-16
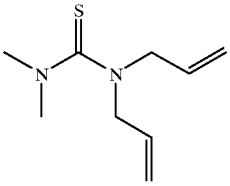
I-17
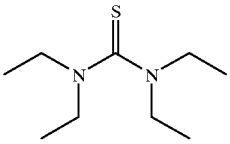
I-18
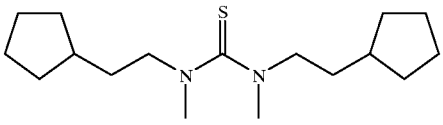
-continued
I-19
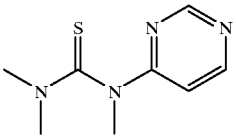
I-20
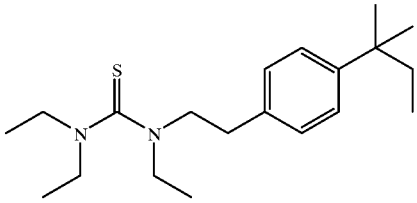
I-21
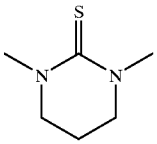
I-22
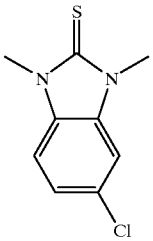
I-23
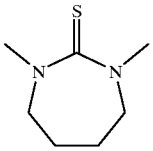
I-24
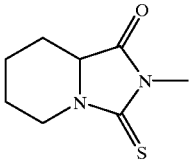
I-25
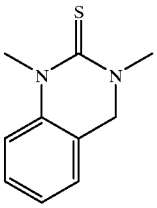
I-26
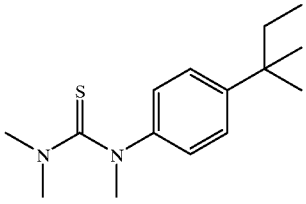

-continued
I-27
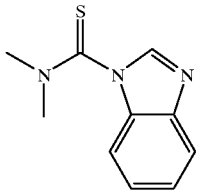
II-1
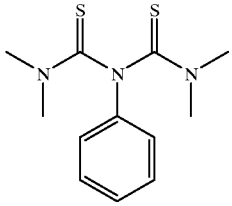
II-2
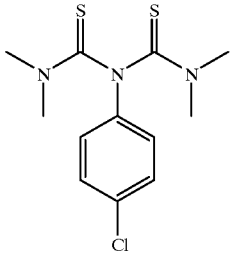
II-3
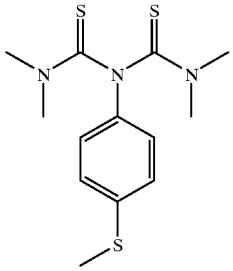
II-4
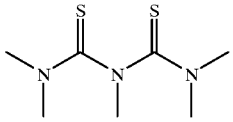
II-5
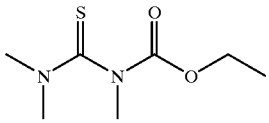
II-6
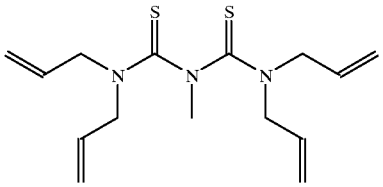
-continued
II-7
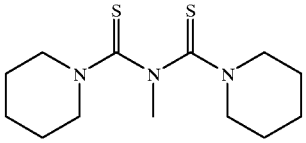
II-8
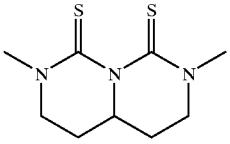
II-9
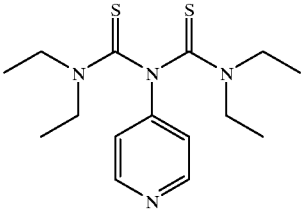
II-10
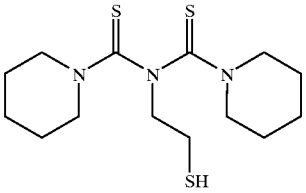
II-11
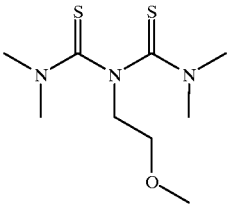
II-12
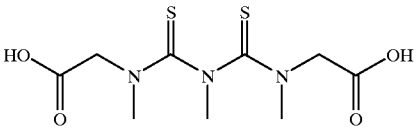
III-1
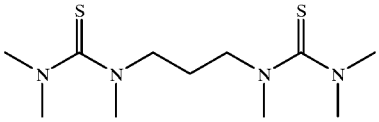
III-2
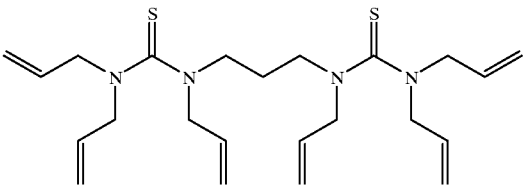

-continued

III-3

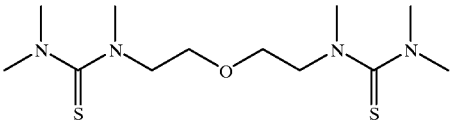

III-4

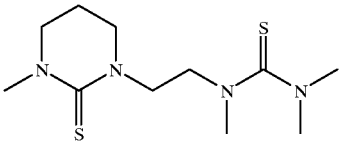

III-5

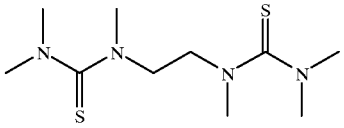

III-6

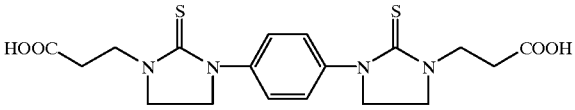

III-7

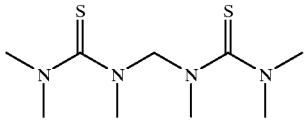

III-8

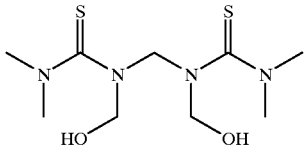

The thiourea speed increasing compounds described herein can be used individually or in mixtures. They can be present in one or more imaging layer(s) on the front side of the photothermographic material. Preferably, they are in every layer that contains photosensitive silver halide. The total amount of such compounds in the material will generally vary depending upon the average size of silver halide grains. The total amount is generally at least $10^{-7}$ mole per mole of total silver, and preferably from about $10^{-5}$ to about $10^{-2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary skill in the art.

The speed increasing compounds useful in the present invention can be purchased from a number of commercial sources (such as Aldrich Chemical Co.), or prepared using readily available starting materials and known procedures as described for example in Belgian Patent Publication 813,926 (May 27, 1959), Schroeder, *Chem.Rev.* 1955, pp. 181–228, Barluenga et al., *Comprehensive Organic Functional Group Transformations,* Vol. 6, 1995, (Katritsky et al., Eds.), pp. 569–585 and references cited therein, and Karkhanis et al., *Phosphorous and Sulfur,* 1985, 22, pp. 49–57.

A representative synthesis of Compound I-2 is as follows:

To a stirred solution of diallylamine (24.2 ml, 0.196 mol) in toluene (50 ml) at 0° C., was added dropwise a solution of thiophosgene (5 g, 0.435 mol) in toluene (10 ml). The resulting solution was allowed to warm slowly to room temperature and stirred overnight, followed by 18 hours at reflux. The resulting reaction mixture was cooled and filtered to remove diallylamine hydrochloride. The solvent was concentrated in vacuo and the residue vacuum distilled to give the desired Compound I-2 (7.47 g, 73% yield, b.p. 105–108° C. at 0.4 mm Hg).

The speed increasing compounds described herein can be added at one or more times during the preparation of the photothermographic emulsion formulations. For example, they can be added before, during or after addition of pyridinium hydrobromide perbromide, calcium bromide, zinc bromide or similar addenda. In some embodiments, they are added before any toning agents (described below) are added to the formulation, or before any spectral sensitizing dyes (described below) are added. It would be readily determinable by routine experimentation as to the optimum time for adding a particular speed increasing compound to achieve the maximum speed enhancement in the photothermographic emulsion.

Additional and conventional chemical sensitizing agents may be used in combination with the speed increasing compounds described above. Such compounds containing sulfur, selenium, or tellurium, or with a compound containing gold, platinum, palladium, ruthenium, rhodium, iridium, or combinations thereof are well known in the art [see for example, U.S. Pat. No. 1,623,499 (Sheppard et al.), U.S. Pat. No. 2,399,083 (Waller et al.), U.S. Pat. No. 3,297,447 (McVeigh) and U.S. Pat. No. 3,297,446 (Dunn)].

It may also be desirable to add sensitizing dyes to enhance silver halide sensitivity to ultraviolet, visible and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.) and U.S. Pat. No. 5,314,795 (Helland et al.) are effective in the practice of the invention.

An appropriate amount of sensitizing dye added is generally about $10^{-10}$ to $10^{-1}$ mole, and preferably, about $10^{-8}$ to $10^{-3}$ moles per mole of silver halide.

To enhance the speed and sensitivity of the photothermographic materials, it is often desirable to use one or more supersensitizers that increase the sensitivity to light. For example, preferred infrared supersensitizers are described in U.S. Pat. No. 5,922,529 (Tsuzuki , et al.), and in EP-A-0 559 228 (Philip Jr. et al.) and include heteroaromatic mercapto compounds or heteroaromatic disulfide compounds of the formulae: Ar—S—M and Ar—S—S—Ar, wherein M represents a hydrogen atom or an alkali metal atom. Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. However, compounds having other heteroaromatic rings are envisioned to be suitable supersensitizers.

The heteroaromatic ring may also carry substituents. Examples of preferred substituents are halogens (such as bromine and chlorine), hydroxy, amino, carboxy, alkyl groups (for example of 1 or more carbon atoms and preferably 1 to 4 carbon atoms) and alkoxy groups (for example of 1 or more carbon atoms and preferably of 1 to 4 carbon atoms).

Examples of supersensitizers are 2-mercaptobenzimidazole, 2-mercapto-5-methylbenzimidazole, 2-mercaptobenzothiazole, 2-mercaptobenzoxazole, and mixtures thereof.

If used, a supersensitizer is generally present in an emulsion layer in an amount of at least about 0.001 mole per mole of silver in the emulsion layer. More preferably, a supersensitizer is present within a range of about 0.001 mole to about 1.0 mole, and most preferably, about 0.01 mole to about 0.3 mole, per mole of silver halide.

Non-Photosensitive Source of Reducible Silver Ions

The non-photosensitive source of reducible silver ions used in photothermographic materials of this invention can be any material that contains reducible silver ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof, hydrocarbon chains having ether or thioether linkages, or sterically hindered substitution in the α-(on a hydrocarbon group) or ortho-(on an aromatic group) position. Preferred examples of the silver salts of aromatic carboxylic acid and other carboxylic acid group-containing compounds include, but are not limited to, silver benzoate, a silver-substituted benzoate, such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates having increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-l-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione].

Furthermore, a silver salt of a compound containing an imino group can be used. Preferred examples of these compounds include but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described for example in U.S. Pat. No. 4,761,361 (Ozaki et al.) and U.S. Pat. No. 4,775,613 (Hirai et al.).

It may also be convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films, a silver carboxylate full soap, containing not more than about 15% of free fatty carboxylic acid and analyzing about 22% silver, can be used. For opaque photothermographic materials, different amounts can be used. The methods used for making silver soap emulsions are well known in the art and are disclosed in Research Disclosure, April 1983, Item No. 22812, Research Disclosure, October 1983, Item No. 23419, U.S. Pat. No. 3,985,565 (Gabrielsen et al.) and the references cited above.

The photocatalyst and the non-photosensitive source of reducible silver ions must be in catalytic proximity (i.e., reactive association). "Catalytic proximity" or "reactive association" means that they should be in the same layer or in adjacent layers. It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the source of reducible silver ions is generally present in an amount of from about 0.001 to about 0.2 mol/m$^2$ of material, and preferably from about 0.01 to about 0.05 mol/m$^2$ of material.

When silver halide is used as the photocatalyst, the total amount of silver (from all silver sources) in the photothermographic materials is generally at least 0.002 mol/m$^2$ and preferably from about 0.01 to about 0.05 mol/m$^2$.

Reducing Agents

The reducing agent (or reducing agent composition comprising two or more components) for the source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat. No. 6,020,117 (Bauer et al.).

In some instances, the reducing agent composition comprises two or more components such as a hindered phenol developer and a co-developer that can be chosen from the various classes of reducing agents described below. For example, hindered phenol developers may be used in combination with hydrazine, sulfonyl hydrazide, trityl hydrazide, formyl phenyl hydrazide, 3-heteroaromatic-substituted acrylonitrile, and 2-substituted malondialdehyde co-developer compounds described below. Ternary developer mixtures involving the further addition of contrast enhancing agents such as hydrogen atom donor, hydroxylamine, alkanolamine, ammonium phthalamate, hydroxamic acid, and N-acyl-hydrazine compounds are also useful.

Hindered phenol reducing agents are preferred. These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl)methanes, bis (hydroxyphenyl)methanes, hindered phenols, and hindered naphthols each of which may be variously substituted.

Representative binaphthols include but are not limited to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include but are not limited to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetra-methylbiphenyl. For additional compounds see U.S. Pat. No. 5,262,295 (noted above).

Representative bis(hydroxynaphthyl)methanes include but are not limited to 4,4'-methylenebis(2-methyl-1-naphthol). For additional compounds see U.S. Pat. No. 5,262,295 (noted above).

Representative bis(hydroxyphenyl)methanes include but are not limited to bis(2-hydroxy-3-t-butyl-5-methylphenyl) methane (CAO-5), 1,1-bis(2-hydroxy-3,5-dimethylphenyl)-3,5,5-trimethylhexane (NONOX or PERMANAX WSO), 1,1-bis(3,5-di-t-butyl-4-hydroxyphenyl)methane, 2,2-bis(4-hydroxy-3-methylphenyl)propane, 4,4-ethylidene-bis(2-t-butyl-6-methylphenol) and 2,2-bis(3,5-dimethyl-4-hydroxyphenyl)propane. For additional compounds see U.S. Pat. No. 5,262,295 (noted above).

Representative hindered phenols include but are not limited to 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include but are not limited to 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienylamidoxime and p-phenoxyphenylamidoxime, azines (for example 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alanine-hydroxamic acid), a combination of azines and sulfonamidophenols (for example phenothiazine and 2,6-dichloro-4-benzenesulfonamidophenol), α-cyanophenyl-acetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example 2,4-dihydroxybenzophenone or 2,4-dihydroxyacetophenone), 5-pyrazolones such as 3-methyl-1-phenyl-5-pyrazolone, reductones (such as dimethylamino-hexose reductone, anhydrodihydro-aminohexose reductone and anhydrodihydro-piperidone-hexose reductone), sulfamidophenol reducing agents (such as 2,6-dichloro-4-benzenesulfonamido-phenol, and p-benzenesulfonamido-phenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1 4-dihydropyridine), bisphenols [such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol) and 2,2-bis(3,5-dimethyl-4-hydroxyphenyl)propane], ascorbic acid derivatives (such as 1-ascorbylpalmitate, ascorbylstearate and unsaturated aldehydes and ketones), 3-pyrazolidones, and certain indane-1,3-diones.

Still other useful reducing agents are described for example in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.).

Useful co-developer reducing agents can also be used as described for example in copending U.S. Ser. No. 09/239,182 (filed Jan. 28, 1999 by Lynch and Skoog). These compounds are generally defined as having the following formula:

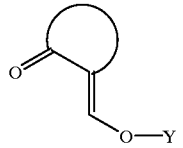

wherein Y is H, a metal cation (such as zinc ion, ammonium ion, alkali metals, alkaline earth metals but preferably, sodium or potassium), or an alkyl group (preferably, an alkyl group having from 1 to 4 carbon atoms, and more preferably, a methyl or ethyl group), and the solid curved line represents the atoms and bonds necessary to complete a 5- to 6-membered carbocyclic or heterocyclic main ring structure that may include heteroatoms (for example nitrogen, oxygen and sulfur). The main ring structure can include one or more additional rings, including pendant and fused rings of any suitable size. Examples of these compounds include, but are not limited to, 2,5-dioxo-cyclopentane carboxaldehyde, 5-(hydroxymethylene)-2,2-dimethyl-1,3-dioxane-4,6-dione, 5-(hydroxymethylene)-1,3-dialkylbarbituric acids, 2-(ethoxymethylene)-1H-indene-1,3(2H)-dione.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Additional classes of reducing agents that can be used as co-developers are substituted hydrazines including the sulfonyl hydrazides described in U.S. Pat. No. 5,464,738 (Lynch et al.) and U.S. Pat. No. 5,492,803 (Landgrebe et al.), trityl hydrazides as described in U.S. Pat. No. 5,496,695 (Simpson et al.), formyl phenyl hydrazides as described in U.S. Pat. No. 5,545,505 (Simpson), 3-heteroaromatic-substituted acrylonitrile compounds as described in U.S. Pat. No. 5,635,339 (Murray), 2-substituted malondialdehyde compounds as described in U.S. Pat. No. 5,654,130 (Murray), and 4-substituted isoxazole compounds as described in U.S. Pat. No. 5,705,324 (Murray).

Other Addenda

The photothermographic materials of the invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

The photothermographic materials of the present invention can be further protected against the production of fog and can be stabilized against loss of sensitivity during storage. While not necessary for the practice of the invention, it may be advantageous to add mercury (II) salts to the imaging layer(s) as an antifoggant. Preferred mercury (II) salts for this purpose are mercuric acetate and mercuric bromide.

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), mercury salts as described in U.S. Pat. No. 2,728,663 (Allen), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), and 2-(tribromomethylsulfonyl) quinoline compounds as described in U.S. Pat. No. 5,460,938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.) and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in copending U.S. Ser. No. 09/301,652 (filed Apr. 28, 1999 by Kong, Sakizadeh, LaBelle, Spahl and Skoug).

Furthermore, specific useful antifoggants/stabilizers have the general structure:

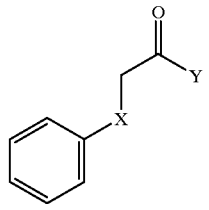

wherein X is —O— or —S—, and Y is —$NH_2$, —OH, or —$O^-M^+$ wherein $M^+$ is a metal atom, can be included in the imaging layers of the materials. These compounds and their use are described in more detail in U.S. Pat. No. 6,083,681 (Lynch et al.) incorporated herein by reference.

Other antifoggants are hydrobromic acid salts of heterocyclic compounds (such as pyridinium hydrobromide perbromide) as described for example, in U.S. Pat. No. 5,028,523 (Skoug), compounds having —$SO_2CBr_3$ groups as described for example in U.S. Pat. No. 5,594,143 (Kirk et al.) and U.S. Pat. No. 5,374,514 (Kirk et al.), benzoyl acid compounds as described for example in U.S. Pat. No. 4,784,939 (Pham), substituted propenitrile compounds as described for example in U.S. Pat. No. 5,686,228 (Murray et al.), silyl blocked compounds as described for example in U.S. Pat. No. 5,358,843 (Sakizadeh et al.), vinyl sulfones as described for example in EP- A-0 600,589 (Philip, Jr. et al.), and EP-A-0 600,586 (Philip, Jr. et al.), and tribromomethylketones as described for example in EP-A-0 600,587 (Oliff et al.).

Preferably, the photothermographic materials of this invention include one or more polyhalo antifoggants that include one or more polyhalo substituents including but not limited to, dichloro, dibromo, trichloro and tribromo groups. The antifoggants can be aliphatic, alicyclic or aromatic compounds, including aromatic heterocyclic and carbocyclic compounds.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include but are not limited to phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes (such as cobaltic hexamine trifluoroacetate), mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides [such as (N,N-dimethylaminomethyl)phthalimide, and N-(dimethylaminomethyl)naphthalene-2,3-dicarboximide], a combination of blocked pyrazoles, isothiuronium derivatives, and certain photobleaching agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes { such as 3-ethyl-5-[(3-ethyl-2-benzothiazolinylidene)-1-methyl-ethylidene]-2-thio-2,4-o-azolidinedione}, phthalazine and derivatives thereof, phthalazinone and phthalazinone derivatives, or metal salts or these derivatives [such as 4-(1-naphthyl) phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], inorganic peroxides and persulfates (such as ammonium peroxydisulfate and hydrogen peroxide), benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3*a*,5,6*a*-tetraazapentalene and 1,4-di-(o-chlorophenyl)-3,6-dimercapto-1H,4H-2,3*a*,5,6*a*-tetraazapentalene].

Various contrast enhancers can be used in some photothermographic materials with specific co-developers. Examples of useful contrast enhancers include, but are not limited to, hydroxylamine, alkanolamines and ammonium phthalamate compounds as described for example in U.S. Pat. No. 5,545,505 (Simpson), hydroxamic acid compounds as described for example in U.S. Pat. No. 5,545,507 (Simpson et al.), and N-acylhydrazine compounds as described for example in U.S. Pat. No. 5,558,983 (Simpson et al.).

Binders

The photocatalyst, (such as photosensitive silver halide), the non-photosensitive source of reducible silver ions, the reducing agent composition, and any other additives used in the present invention are generally added to at least one or more binders that are either hydrophilic or hydrophobic. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. A particularly suitable polyvinyl butyral binder is available as BUTVAR® B79 (Solutia).

Examples of useful hydrophilic binders include, but are not limited to, gelatin and gelatin-like derivatives (hardened or unhardened), cellulosic materials such as cellulose acetate, cellulose acetate butyrate, hydroxymethyl cellulose, acrylamide/methacrylamide polymers, acrylic/methacrylic polymers polyvinyl pyrrolidones, polyvinyl acetates, polyvinyl alcohols and polysaccharides (such as dextrans and starch ethers).

Hardeners for various binders may be present if desired. Useful hardeners are well known and include diisocyanate compounds as described for example in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder not decompose or lose its structural integrity at 120° C. for 60 seconds, and more preferred that it not decompose or lose its structural integrity at 177° C. for 60 seconds.

The polymer binder(s) is used in an amount sufficient to carry the components dispersed therein that is within the effective range of the action as the binder. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which they are included.

Support Materials

The photothermographic materials of this invention comprise a polymeric support that is preferably a flexible, transparent film that has any desired thickness and is composed of one or more polymeric materials depending upon their use. The supports are generally transparent or at least translucent, but in some instances, opaque supports may be useful. They are required to exhibit dimensional stability during development and to have suitable adhesive properties with overlying layers. Useful polymeric materials for making such supports include, but are not limited to, polymers (such as polyethylene terephthalate and polyethylene naphthalate), cellulose acetate and other cellulose esters, polyvinyl acetal, polyolefins (such as polyethylene and polypropylene), polycarbonate, and polystyrenes. Preferred supports are composed of polymers having good heat stability, such as polyesters and polycarbonate. Polyethylene terephthalate film is the most preferred support. Various support materials are described, for example, in Research Disclosure, August 1979, Item No. 18431.

Opaque supports can also be used including dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials including vinylidene halide polymers.

Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone, acetone or tetrahydrofuran.

Photothermographic materials can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont).

The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn).

Polymeric fluorinated surfactants may also be useful in one or more layers of the imaging materials for various purposes, including coatability and optical density uniformity as described in U.S. Pat. No. 5,468,603 (Kub).

EP-A-0 792 476 (Geisler et al.) describes various means of modifying the photothermographic materials to reduce what is known as the "woodgrain" effect, or uneven optical density. This effect can be reduced or eliminated by treating the support surface, inducing a certain amount of haze in a topcoat, or by adding acutance dyes to one or more layers.

The photothermographic materials can include antistatic or conducting layers. Such layers may contain soluble salts (for example chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electro-conductive underlayers such as those described in U.S. Pat. No. 5,310,640 (Markin et al.) electronically-conductive metal antimonate particles such as those described in U.S. Pat. No. 5,368,995 (Christian et al.), and electrically-conductive metal-containing particles dispersed in a polymeric binder such as those described in EP-A- 0 678 776 (Melpolder et al.). Other antistatic agents are well known in the art.

The photothermographic materials may also contain electro-conductive underlayers to reduce static electricity effects and improve transport through processing equipment. Such layers are described in U.S. Pat. No. 5,310,640 (Markin et al.).

The photothermographic materials can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two layer constructions comprising a single imaging layer coating containing all the ingredients and a protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in photothermographic materials are also known, as described for example in U.S. Pat. No. 5,891,610 (Bauer et al.), U.S. Pat. No. 5,804,365 (Bauer et al.) and U.S. Pat. No. 4,741,992 (Przezdziecki). Adhesion can also be promoted using specific polymeric adhesive materials is adhered layers as described for example in U.S. Pat. No. 5,928,857 (Geisler et al.).

Photothermographic formulations described can be coated by various coating procedures including wire wound rod coating, dip coating, air knife coating, curtain coating, slide coating or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.) and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single phase mixture of the two or more polymers described above may be used. Such formulations are described in copending and commonly assigned U.S. Ser. No. 09/510,648 filed Feb. 23, 2000 by Ludemann et al. that is based on Provisional Application 60/121,794, filed Feb. 26, 1999.

Mottle and other surface anomalies can be reduced in the materials of this invention by incorporation of a fluorinated polymer as described for example in U.S. Pat. No. 5,532,121 (Yonkonski et al.) or by using particularly drying techniques as described for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, the method can also include forming on the opposing or backside side of said polymeric support, one or more additional layers, including an antihalation layer, an antistatic layer, or a layer containing a matting agent (such as silica), or a combination of such layers. It is also contemplated that the photothermographic materials of this invention can include imaging layers on both sides of the support.

Photothermographic materials according to the present invention can have one or more layers incorporating one or more acutance dyes and/or antihalation dyes. These dyes are chosen to have absorption close to the exposure wavelength and are designed to absorb scattered light. One or more antihalation dyes may be incorporated into one or more antihalation layers according to known techniques as an antihalation backing layer, an antihalation underlayer or as an overcoat. It is preferred that the photothermographic materials of this invention contain an antihalation coating on the support opposite to the side on which the emulsion and topcoat layers are coated.

To promote image sharpness, one or more acutance dyes may be incorporated into one or more frontside layers such as the photothermographic emulsion layer or topcoat layers according to known techniques.

Dyes particularly useful as antihalation and acutance dyes include dihydroperimidine squaraine antihalation dyes having the nucleus represented by the following general structure:

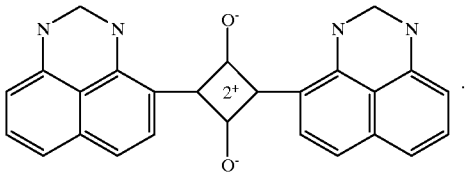

Details of such antihalation dyes having the dihydroperimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt).

Dyes particularly useful as antihalation dyes in a backside layer of the photothermographic material also include indolenine cyanine dyes having the nucleus represented by the following general structure:

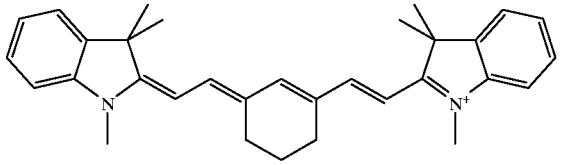

Details of such antihalation dyes having the indolenine cyanine nucleus and methods of their preparation can be found in EP-A-0 342 810 (Leichter), incorporated herein by reference. One particularly useful cyanine dye, compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate.

It is also useful in the present invention to employ acutance or antihalation dyes that will decolorize with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), and EP 0 911 693 A1 (Sakurada et. al.).

Imaging/Development

While the imaging materials of the present invention can be imaged in any suitable manner consistent with the type of material using any suitable imaging source (typically some type of radiation or electronic signal), the following discussion will be directed to the preferred imaging means.

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including Research Disclosure, Vol. 389, Item No. 38957, September 1996 (such as sunlight, xenon lamps and fluorescent lamps). A particularly useful exposure means uses laser diodes includes laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

For using the materials of this invention, development conditions will vary, depending on the construction used but will typically involve heating the imagewise exposed material at a suitably elevated temperature. Thus, the latent image can be developed by heating the exposed material at a moderately elevated temperature of, for example, from about 50 to about 250° C. (preferably from about 80 to about 200° C., and more preferably from about 100 to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a by lower temperature (for example at about 80° C.) in the presence of a transfer solvent.

Use as a Photomask

The photothermographic materials of the present invention are sufficiently transmissive in the range of 350 to 450 nm in non-imaged areas to allow their use in a process where there is a subsequent exposure of an ultraviolet or short wavelength visible radiation sensitive imageable medium. For example, imaging the photothermographic material and subsequent heat development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as, for example, a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

The following examples are provided to illustrate the practice of this invention, and are not intended to be limiting in any manner. The examples provide exemplary synthetic procedures and preparatory procedures using the speed increasing compounds within the scope of the present invention.

Materials and Methods for the Examples

All materials used in the following examples are readily available from standard commercial sources, such as Aldrich Chemical Co. (Milwaukee, Wis.) unless otherwise specified. All percentages are by weight unless otherwise indicated. The following additional terms and materials were used.

ACRYLOID A-21 is an acrylic copolymer available from Rohm and Haas, Philadelphia, Pa.

BUTVAR B-79 is a polyvinyl butyral resin available from Solutia Company, St. Louis, Mo.

CAB 171-15S is a cellulose acetate butyrate resin available from Eastman Chemicals Co.

DESMODULR N3300 is an aliphatic hexamethylene diisocyanate available from Bayer Chemicals, Pittsburgh, Pa.

PERMANAX WSO is 1,1-bis(2-hydroxy-3,5-dimethylphenyl)-3,5,5-trimethylhexane [CAS RN=7292-14-0] and is available from St-Jean PhotoChemicals, Inc. (Quebec). It is a reducing agent (that is a hindered phenol developer) for the non-photosensitive reducible source of silver. It is also known as NONOX.

MEK is methyl ethyl ketone (or 2-butanone).

Dye A is

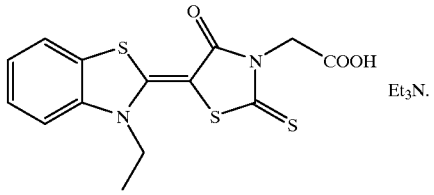

Sensitizing Dye A is

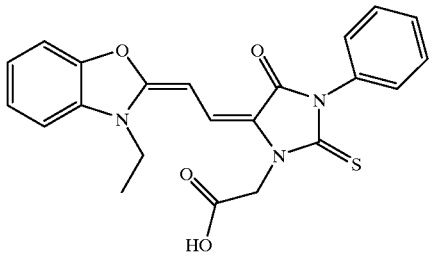

Sensitizing Dye B is

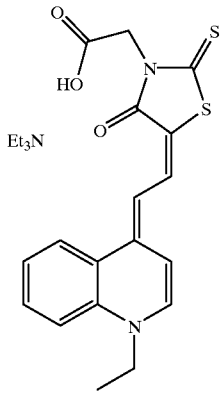

Sensitizing Dye C is

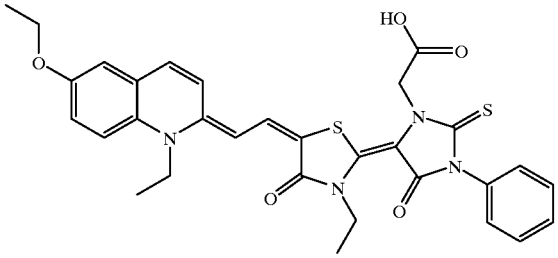

Compound HC-1 is described in U.S. Pat. No. 5,545,515 (noted above) and has the following structure:

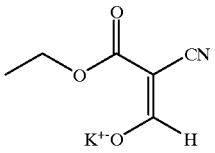

Vinyl Sulfone-1 (VS-1) is described in EP-0 600 589 B1 and has the following structure:

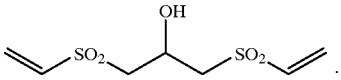

Antifoggant A is 2-(tribromomethylsulfonyl)quinoline and has the following structure:

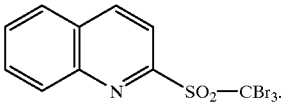

Antifoggant B is:

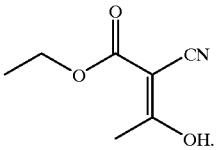

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

BC-1

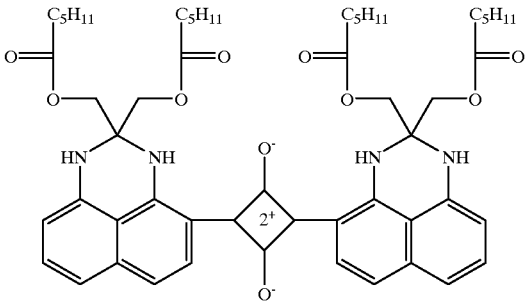

Backcoat Dye BC-2 is 3H-indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate). It is believed to have the structure shown below. Details of such cyanine dyes and methods of their preparation can be found in EP-A-0 342 810 (Leichter), incorporated herein by reference.

BC-2

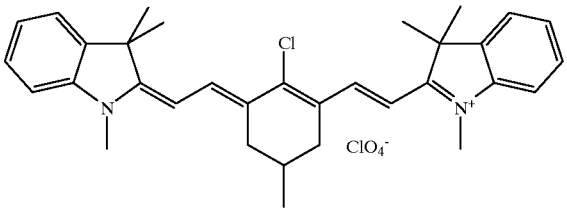

Comparative Compound C-1 has the structure:

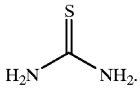

Comparative Compound C-2 has the structure:

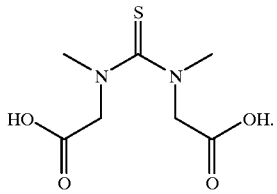

Comparative Compound C-3 has the structure:

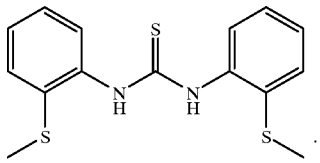

Comparative Compound C-4 has the structure:

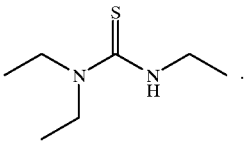

EXAMPLE 1

A pre-formed silver bromoiodide, silver carboxylate soap dispersion was prepared as described in U.S. Pat. No. 5,382,504 (noted above), incorporated herein by reference. A photothermographic emulsion was prepared from this dispersion in a manner similar to that described in U.S. Pat. No. 6,083,681 (noted above) but using the materials and amounts shown below.

| Photothermographic Emulsion Formulation: | |
|---|---|
| To 180 g of this silver soap dispersion were added: | |
| MEK | 20 g |
| Pyridinium hydrobromide perbromide | 0.23 g in 1.0 g methanol |
| Calcium bromide | 0.1 g in 1.0 g methanol |
| Chemical sensitizer | amount specified in TABLE I below |
| Dye premix | (see below for ingredients) |
| BUTVAR B-79 polyvinyl butyral | 20 g |
| Antifoggant A | 1.3 g |
| DESMODUR N3300 | 0.4 g |
| Phthalazine | 1.0 g |
| Tetrachlorophthalic acid | 0.35 g |
| 4-Methylphthalic acid | 0.45 g |
| PERMANAX WSO | 10.6 g |
| Dye Premix Formulation: | |
| Dye A | 0.02 g |
| Chlorobenzoyl benzoic acid | 1.42 g |
| Methanol | 5.0 g |

A protective topcoat for the photothermographic emulsion layer was prepared as follows:

| | |
|---|---|
| ACRYLOID-21 polymer | 0.56 g |
| CAB 171-15S cellulose acetate butyrate | 15 g |
| MEK | 183 g |
| VS-1 | 0.27 g |
| Antifoggant B | 0.08 g |
| Benzotriazole | 1.60 g |

The photothermographic emulsion and topcoat formulations were coated under safelight conditions onto a 7 mil (178 $\mu$m) blue tinted polyethylene terephthalate support provided with a backside coating containing Backcoat Dye BC-1 in CAB 171-15S resin using a conventional dual-knife coating machine. Coating and drying were carried out also as described in U.S. Pat. No. 6,083,681.

Samples of the resulting photothermographic materials were imagewise exposed for $10^{-3}$ seconds using a conventional EG&G Flash sensitometer with a P-31 filter and developed using a heated roll processor for 15 seconds at 124° C.

Densitometry measurements were made on a custom built computer-scanned densitometer using a filter appropriate to the sensitivity of the photothermographic material and are believed to be comparable to measurements from commercially available densitometers. $D_{min}$ is the density of the non-exposed areas after development and it is the average of the eight lowest density values. "SP-2" is Log1/E+4 corresponding to the density value of 1.00 above $D_{min}$ where E is the exposure in ergs/cm$^2$. "SP-3" is Log1/E+4 corresponding to the density value of 2.90 above $D_{min}$ where E is the exposure in ergs/cm$^2$. Average Contrast-1 ("AC-1") is the absolute value of the slope of the line joining the density points of 0.60 and 2.00 above $D_{min}$. "CON-D" is the absolute value of the slope of the line joining the density points of 1.00 and 3.00 above $D_{min}$.

In this example, the photothermographic imaging (emulsion) layer comprised green-sensitive, 0.12 $\mu$m silver bromide grains that were spectrally sensitized using Sensitizing Dye A. The sensitometric results of the resulting photothermographic material are shown in the following TABLE I. The changes in $D_{min}$ and speed are relative to a control photothermographic material from which the chemical sensitizer has been omitted, but otherwise prepared identically to the invention materials.

TABLE I

| Chemical Sensitizer | Amount | $\Delta D_{min}$ | ΔSP-2 |
|---|---|---|---|
| Thiourea I-1 | 10 mg | 0 | +0.35 |
| C-1 | 10 mg | Sample fogged to $D_{max}$ | |
| C-2 | 20 mg | +0.04 | −0.21 |
| C-3 | 15 mg | −0.04 | −0.86 |

EXAMPLE 2

Several photothermographic materials similar to that described in Example 1 were prepared using 0.05 μm iridium- and copper-doped core-shell silver halide grain emulsions as described in U.S. Pat. No. 5,939,249 (noted above) and various chemical sensitizers (speed increasing compounds). The amount of chemical sensitizer was $4.4\times10^{-5}$ mole per 250 g batch of emulsion. A photothermographic emulsion was prepared from this dispersion in a manner similar to that described in U.S. Pat. No. 6,083,681 (noted above) but using the materials and amounts shown below.

| Photothermographic Emulsion Formulation | |
|---|---|
| To 169 g of this silver carboxylate dispersion at 28.8% solids were added: | |
| Pyridinium hydrobromide perbromide | 0.20 g in 1.58 g methanol |
| Calcium bromide | 0.15 g in 1.19 g methanol |
| Thiourea chemical sensitizer | $4.4\times10^{-5}$ mol in 5 g methanol |
| Dye premix | (see below) |
| BUTVAR B-79 polyvinyl butyral | 20 g |
| Antifoggant A | 0.6 g in 10 g MEK |
| DESMODUR N3300 | 0.75 g in 0.75 g MEK |
| Phthalazine | 1.05 g in 3.0 g MEK |
| Tetrachlorophthalic acid | 0.35 g in 2.0 g MEK |
| 4-Methylphthalic acid | 0.45 g in 2.5 g MEK |
| PERMANAX WSO | 10.6 g |
| MEK | amount necessary to make 250 g total batch size |
| Dye Premix Formulation: | |
| Sensitizing dye A | 0.020 g |
| Chlorobenzoyl benzoic acid | 1.42 g |
| Methanol | 5.0 g |

A protective topcoat for the photothermographic emulsion layer was prepared as follows:

| | |
|---|---|
| ACRYLOID-21 polymer | 2.0 g |
| CAB 171-15S cellulose acetate butyrate | 51.24 g |
| MEK | 639 g |
| VS-1 | 1.45 g of 80% solids |
| Benzotriazole | 5.5 g |
| Antifoggant B | 9.4 g |

The photothermographic emulsion and topcoat formulations were coated, imaged and developed as described in Example 1. The resulting sensitometric data are recorded in TABLE II below. The changes in $D_{min}$ and speed are relative to a control photothermographic material from which the thiourea chemical sensitizer has been omitted, but otherwise prepared identically to the invention materials. Thiourea chemical sensitizer Compound I-2 appears to show the best gain in speed coupled with small increase in $D_{min}$ and is a preferred compound.

TABLE II

| Chemical Sensitizer | $\Delta D_{min}$ | ΔSP-2 |
|---|---|---|
| I-1 | +0.071 | +0.364 |
| I-2 | +0.036 | +0.420 |
| I-3 | +0.012 | +0.355 |
| I-4 | +0.149 | +0.665 |
| I-5 | −0.001 | +0.384 |
| I-6 | +0.055 | +0.025 |
| I-7 | +0.106 | +0.204 |
| I-8 | +0.001 | +0.022 |
| II-1 | +0.053 | +0.453 |
| I-9 | +0.132 | +0.379 |
| I-10 | +0.001 | +0.022 |
| II-2 | +0.021 | +0.385 |
| I-11 | +0.004 | +0.246 |
| II-3 | +0.499 | +0.538 |
| I-12 | +0.542 | +0.669 |
| I-13 | +0.018 | +0.130 |
| I-14 | +0.166 | +0.449 |
| I-15 | +0.132 | +0.379 |
| I-16 | +0.009 | +0.255 |
| C-2 | +0.050 | −0.100 |
| C-4 | +0.024 | −0.20 |

EXAMPLE 3

A study was carried out to show the effect of different levels of thiourea chemical sensitizer (speed increasing compound) using a photothermographic material like that described in Example 1, containing 0.05 μm silver halide grains sensitized using Sensitizing dye A. The "1X" level represents $4.4\times10^{-5}$ moles of chemical sensitizer per 250 g batch of photothermographic emulsion formulation. The sensitometric results are shown in TABLE III below. The change in speed is relative to a control photothermographic material from which the chemical sensitizer has been omitted, but otherwise prepared identically to the invention materials.

TABLE III

| Thiourea Chemical Sensitizer | AgX Grain Size (μm) | Amount | $\Delta D_{min}$ | ΔSP-2 |
|---|---|---|---|---|
| I-2 | 0.05 | 1 X | 0.014 | +0.26 |
| I-2 | 0.05 | 2 X | 0.018 | +0.36 |

EXAMPLE 4

This example demonstrates the effect of the chemical sensitizers (speed increasing compounds) in photothermographic materials prepared as described in U.S. Pat. No. 5,434,043 (noted above) but containing different silver halide grain sizes. The silver halide grains were sensitized using a red sensitizing dye and high contrast agent HC-1. All of the materials provided a "Con-D" greater than 10. A photothermographic emulsion was prepared from this dispersion in a manner similar to that described in U.S. Pat. No. 6,083,681 (noted above) but using the materials and amounts shown below.

| Photothermographic Emulsion Formulation | |
|---|---|
| To 182 g of a silver soap dispersion containing 24.5% solids were added: | |
| MEK | 8 g |
| Pyridinium hydrobromide perbromide | 0.254 g |
| Zinc bromide | 0.288 g |
| Compound I-2 | (see TABLE V below) |
| Dye premix: | |
| Chlorobenzoyl benzoic acid at 2.32 g and Sensitizing Dye B or C at $2.368 \times 10^{-5}$ mole in methanol at 9.82 g | |
| BUTVAR B-79 polyvinyl butyral | 31.8 g |
| Antifoggant A | 1.6 g |
| DESMODUR N3300 | 0.49 g |
| Phthalazine | 1.2 g |
| Tetrachlorophthalic acid | 0.27 g |
| 4-Methylphthalic acid | 0.60 g |
| PERMANAX WSO | 12.0 g |
| HC-1 high contrast agent | 0.215 g |

A protective topcoat for the photothermographic emulsion layer was prepared as follows:

| | |
|---|---|
| ACRYLOID-21 polymer | 0.052 g |
| CAB 171-15S cellulose acetate butyrate | 1.34 g |
| MEK | 16.95 g |
| VS-1 | 0.079 g |

The resulting photothermographic emulsion and protective topcoat formulations were imagewise exposed using a conventional scanning laser sensitometer having a 670 nm laser diode. The materials were then developed using a heated roll processor for 13 seconds at 118° C. TABLE IV below contains the resulting sensitometric data. The changes in $D_{min}$ and speed are relative to a control photothermographic material from which the thiourea chemical sensitizer has been omitted, but otherwise prepared identically to the invention materials.

TABLE IV

| Thiourea Chemical Sensitizer | Average Grain Size (μm) | Amount (g) | Sensitizing Dye | $\Delta D_{min}$ | ΔSP-3 |
|---|---|---|---|---|---|
| I-2 | 0.065 | 0.0139 | C | 0.037 | 0.80 |
| I-2 | 0.60 | 0.0139 | B | 0.009 | 0.68 |

EXAMPLE 5

This example demonstrates the use of speed increasing compounds (chemical sensitizers) in green sensitive, high contrast photothermographic materials. A pre-formed silver halide, silver carboxylate emulsion was prepared as described in U.S. Pat. No. 5,382,504 (noted above). The average silver halide grain size was 0.12 μm. A photothermographic emulsion was prepared from this dispersion in a manner similar to that described in U.S. Pat. No. 6,083,681 (noted above) but using the materials and amounts shown below.

| Photothermographic Emulsion Formulation: | |
|---|---|
| To 188 g of this silver soap dispersion at 24.5% solids were added: | |
| Pyridinium hydrobromide perbromide | 0.20 g in 1.58 g of methanol |
| Calcium bromide | 0.15 g in 1.19 g of methanol |
| Compound I-2 (see TABLES V and VI below) | in 5.0 g of methanol) |
| Dye premix | (see below for ingredients) |
| BUTVAR B-79 polyvinyl butyral | 20 g |
| Antifoggant A | 0.6 g in 10.0 g of MEK |
| PERMANAX WSO | 10.6 g |
| DESMODUR N3300 | 0.63 g in 1.5 g of MEK |
| Tetrachlorophthalic acid | 0.35 g in 2.0 g of MEK |
| Phthalazine | 1.00 g in 5.0 g of MEK |
| 4-Methylphthalic acid | 0.45 g in 0.5 g methanol/3.5 g MEK |
| Dye Premix Formulation: | |
| Sensitizing dye A | 0.0475 mmol |
| Chlorobenzoyl benzoic acid | 1.42 g |
| Methanol | 5.0 g |

A protective topcoat for the photothermographic emulsion layer was prepared as follows:

| | |
|---|---|
| ACRYLOID-21 polymer | 0.58 g |
| CAB 171-15S cellulose acetate butyrate | 14.9 g |
| MEK | 184 g |
| VS-1 | 0.3 g |
| Benzotriazole | 1.6 g |
| Antifoggant B | 0.12 g |
| High contrast additive HC-1 | 0.05 g |

The photothermographic emulsion and protective topcoat formulations materials were coated, imaged, and developed as described in Example 1. The materials were shown to have an average contrast (AC-1) greater than 6 and the other sensitometric results are shown in TABLE V below. The changes in $D_{min}$ and speed are relative to a control photothermographic material from which the thiourea chemical sensitizer has been omitted, but otherwise prepared identically to the invention materials.

TABLE V

| Thiourea Chemical Sensitizer | Amount (mmol) | $\Delta D_{min}$ | ΔSP-2 |
|---|---|---|---|
| I-2 | 0.0441 | 0.120 | 0.640 |

Similar photothermographic materials were prepared but the average silver halide grain size was 0.05 μm as described in U.S. Pat. No. 5,939,249 (noted above). After imagewise exposure and heat development, the materials were shown to have an average contrast (AC-1) greater than 10. Other sensitometric results are as shown in TABLE VI below. The changes in $D_{min}$ and speed are relative to a control photothermographic material from which the thiourea chemical sensitizer has been omitted, but otherwise prepared identically to the invention materials.

TABLE VI

| Thiourea Chemical Sensitizer | Amount (mmol) | $\Delta D_{min}$ | ΔSP-2 |
|---|---|---|---|
| I-2 | 0.0882 | 0.021 | 0.475 |

EXAMPLE 6

This example demonstrates the utility of a combination of thiourea speed increasing compounds (chemical sensitizers) within the scope of this invention with the type of chemical sensitizers described in U.S. Pat. No. 5,891,615 (noted above). Photothermographic materials were prepared as described in Example 5 except that they contained silver halide having an average grain size of 0.05 μm, did not contain high contrast agent HC-1, and Dye-A was added in an amount of 0.02 g in 5.0 g of methanol before the addition of pyridinium hydrobromide perbromide.

After imagewise exposure and heat development, the materials provided the sensitometric results shown in TABLE VII below. The changes in $D_{min}$ and speed are relative to a control photothermographic material from which the thiourea chemical sensitizer has been omitted, but otherwise prepared identically to the invention materials.

TABLE VII

| Chemical Sensitizer | I-1 or I-2 Amount (mmol) | $\Delta D_{min}$ | ΔSP-2 |
|---|---|---|---|
| I-2 | 0.0882 | 0.009 | 0.398 |
| Dye A | 0 | 0.005 | 0.465 |
| I-1 + Dye A | 0.00022 | 0.013 | 0.566 |

The invention has been described in detail with particular reference to certain preferred embodiments thereof, but it will be understood that variations and modifications can be effected within the spirit and scope of the invention.

We claim:

1. A photothermographic material comprising a support having thereon one or more layers comprising a binder and in reactive association:

a. a photocatalyst, b. a non-photosensitive source of reducible silver ions, c. a reducing composition for said reducible silver ions, and d. an organic solvent-soluble thiourea speed increasing compound represented by the following Structure I, II, or III:

I

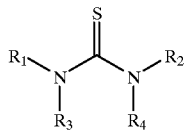

II

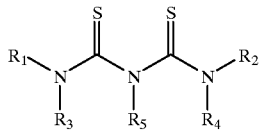

-continued

III

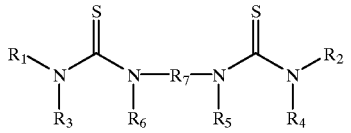

wherein:

in Structure I, $R_1$, $R_2$, $R_3$ and $R_4$ are independently alkyl, cycloalkyl, allyl, alkenyl, alkynyl, aryl or heterocyclic groups, or $R_1$ and $R_2$ taken together, $R_3$ and $R_4$ taken together, $R_1$ and $R_3$ taken together or $R_2$ and $R_4$ taken together, can form a 5- to to 7-membered heterocyclic ring, in Structure II, $R_1$, $R_2$, $R_3$, $R_4$ and $R_5$ are independently alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, in Structure III, $R_1$, $R_2$, $R_3$, $R_4$, $R_5$, and $R_6$ are independently alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, provided that said speed increasing compound represented by Structure I does not require a heat activation step at 30° C. or higher temperature for at least 5 minutes, has a pKa of at least 7, and is free of exocyclic carbon-carbon double bonds and nucleophilic groups.

2. The photothermographic material of claim 1 wherein said photocatalyst is a silver halide, or a mixture of silver halides.

3. The photothermographic material of claim 1 wherein said thiourea speed increasing compound of Structure I has a pKa of at least 7.5.

4. The photothermographic material of claim 1 wherein said speed increasing compound is represented by Structure I, II, or III wherein $R_1$, $R_2$, $R_3$, $R_4$, $R_5$, or $R_6$ are independently methyl, ethyl, phenyl tolyl, cyclopentyl, cyclohexyl, allyl, morpholino, or piperazino groups, and $R_7$ is an alkylene group having at least 2 carbon atoms.

5. The photothermographic material of claim 1 wherein said speed increasing compound is selected from the following group of compounds:

I-1

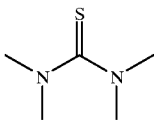

-continued
I-2
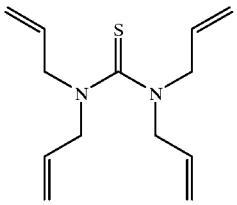
I-3
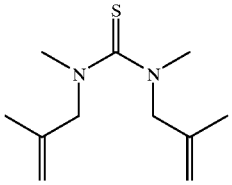
I-4
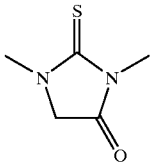
I-5
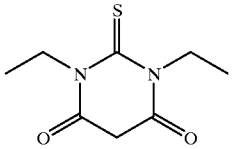
I-6
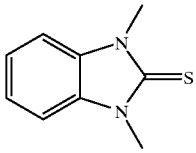
I-7
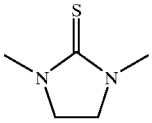
I-8
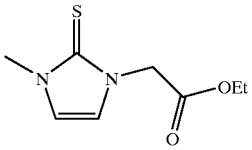
I-9
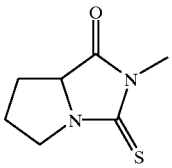
-continued
I-10
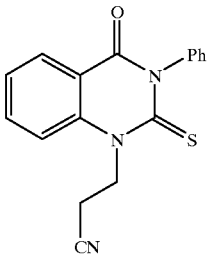
I-11
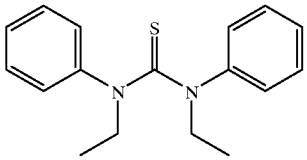
I-12
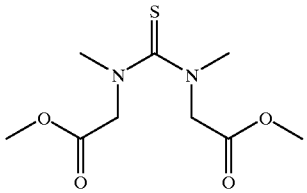
I-13
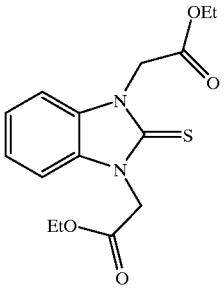
I-14
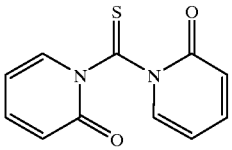
I-15
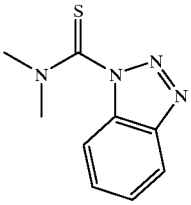
I-16
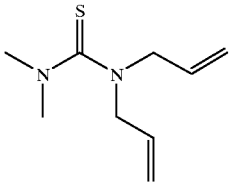

-continued
I-17
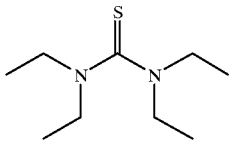
I-18
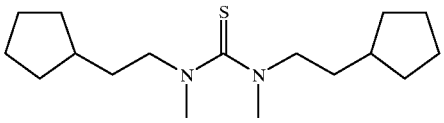
I-19
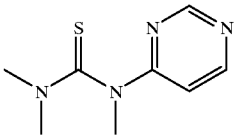
I-20
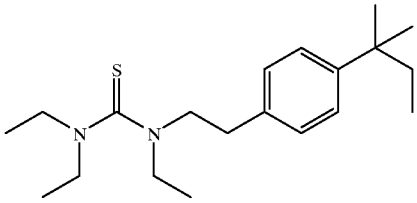
I-21
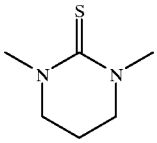
I-22
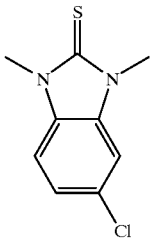
I-23
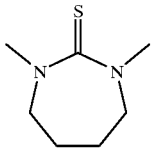
I-24
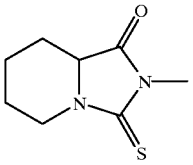
-continued
I-25
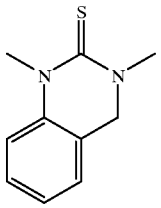
I-26
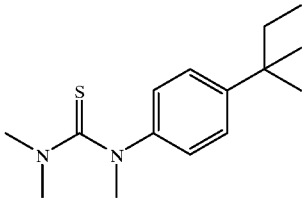
I-27
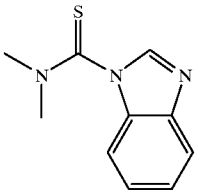
II-1
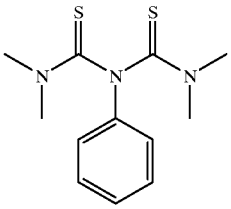
II-2
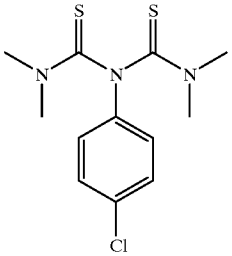
II-3
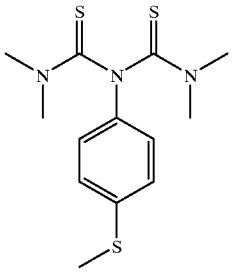
II-4
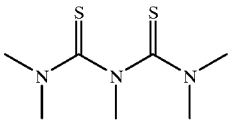

-continued

II-5

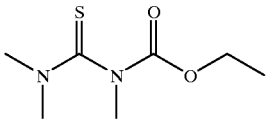

II-6

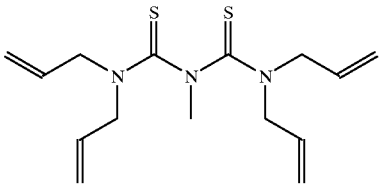

II-7

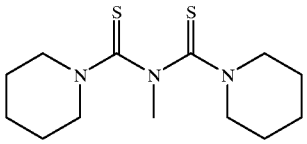

II-8

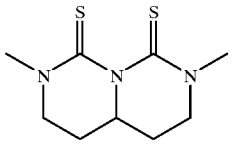

II-9

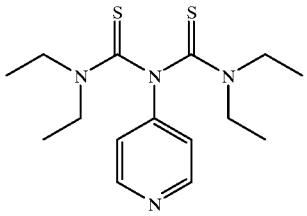

II-10

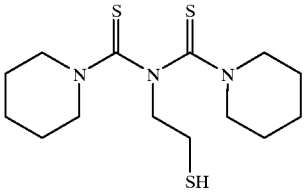

II-11

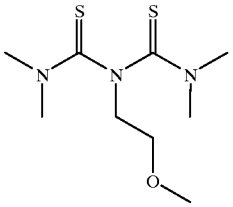

II-12

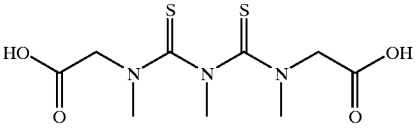

III-1

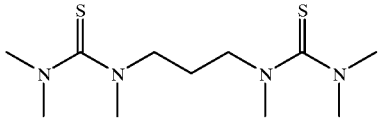

-continued

III-2

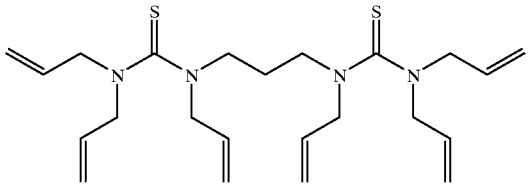

III-3

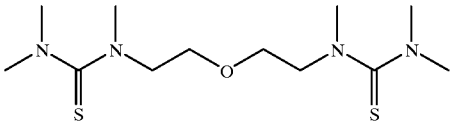

III-4

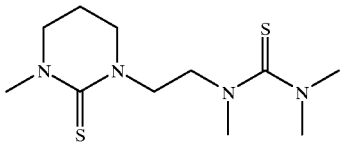

III-5

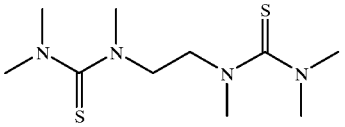

III-6

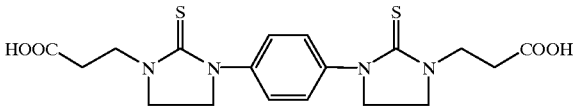

III-7

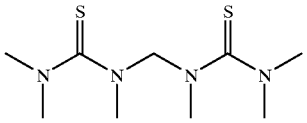

III-8

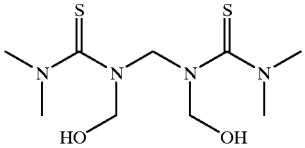

6. The photothermographic material of claim 5 wherein said thiourea speed increasing compound is Compound I-2.

7. The photothermographic material of claim 1 wherein said speed increasing compound is present in an amount of at least $1\times10^{-7}$ mole per mole of silver, and the total silver present in said material is at least 0.002 mol/m$^2$.

8. The photothermographic material of claim 1 wherein said binder is a hydrophobic binder.

9. The photothermographic material of claim 1 wherein said non-photosensitive source of reducible silver ions is a silver salt of a fatty carboxylic acid having from 10 to 30 carbon atoms, or a mixture of said silver salts.

10. The photothermographic material of claim 1 wherein additional chemical sensitization is achieved by oxidative decomposition of a spectral sensitizing dye in the photothermographic emulsion.

11. The photothermographic material of claim 1 further including a co-developer.

12. The photothermographic material of claim 11 wherein said co-developer is selected from the group consisting of hydrazine, sulfonyl hydrazide, trityl hydrazide, formyl phenyl hydrazide, 3-heteroaromatic-substituted acrylonitrile, 2-substituted malondialdehyde, 4-substituted isoxazole, 2,5-dioxo-cyclopentane carboxaldehyde, 5-(hydroxymethylene)-2,2-dimethyl-1,3-dioxane-4,6-dione, 5-(hydroxymethylene)-1,3-dialkylbarbituric acid, and 2-(ethoxymethylene)-1H-indene-1,3(2H)-dione compounds.

13. The photothermographic material of claim 1 comprising one or more silver halides as the photocatalysts comprising silver halide grains having an average particle size of less than about 1.5 $\mu$m.

14. The photothermographic material of claim 1 further comprising one or more antistatic agents.

15. A photothermographic material comprising a transparent support having on one side thereof, one or more photothermographic emulsion layers comprising:

a. one or more silver halides present in an amount of from about 0.005 to about 0.5 mole per mole of a non-photosensitive source of reducible silver ions, b. a non-photosensitive source of reducible silver ions that comprises one or more silver carboxylate salts of a fatty acid having from 10 to30 carbon atoms, said one or more silver carboxylates being present in an amount of from about 10 to about 50 weight % of the total dry weight of said emulsion layer(s), c. one or more hindered phenol reducing agents, d. one or more hydrophobic binders, and d. one or more water-insoluble thiourea speed increasing compound represented by the following Structure I, II, or III:

I

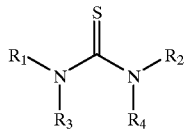

II

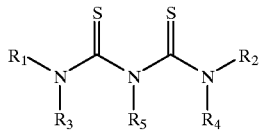

III

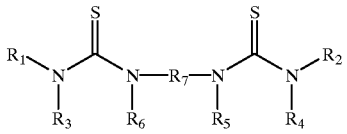

wherein:

in Structure I, $R_1$, $R_2$, $R_3$ and $R_4$ are independently alkyl, cycloalkyl, allyl, alkenyl, alkynyl, aryl or heterocyclic groups, or $R_1$ and $R_2$, take together $R_3$ and $R_4$ taken together, $R_1$ and $R_3$ taken together or $R_2$ and $R_4$ taken together, can form a substituted or unsubstituted 5- to 7-membered heterocyclic ring, in Structure II, $R_1$, $R_2$, $R_3$, $R_4$ and $R_5$ are independently alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, in Structure III, $R_1$, $R_2$, $R_3$, $R_4$, $R_5$, and $R_6$ are independently alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, provided that said speed increasing compound represented by Structure I does not require a heat activation step at 30° C. or higher temperature for at least 5 minutes, has a pKa of at least 7, and is free of exocyclic carbon-carbon double bonds and nucleophilic groups, and said speed increasing compound represented by either Structure I, II, or III is present in said material in an amount of from about $10^{-5}$ to about $10^{-2}$ mol/mo of total silver.

16. The photothermographic material of claim 15 further comprising a protective layer over said photothermographic emulsion layer.

17. The photothermographic material of claim 15 further comprising an antihalation layer on the backside side of said support, said antihalation layer comprising one or more antihalation dyes.

18. The photothermographic material of claim 17 wherein said backside antihalation layer comprises an antihalation dye that is an indolenine cyanine dye having a nucleus represented by the following structure:

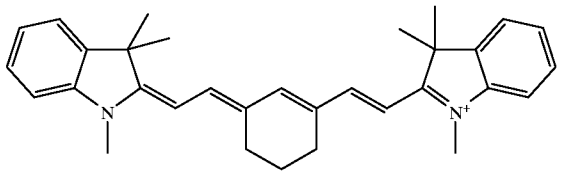

19. The photothermographic material of claim 17 comprising a dihydroperimidine squaraine dye having a nucleus represented by the following structure:

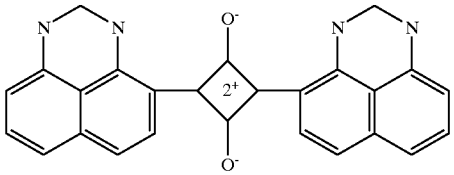

20. The photothermographic material of claim 19 wherein said dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt) that is present as an antihalation or acutance dye.

21. A method of providing an image comprising the steps of:

A) imagewise exposing the photothermographic material of claim 1 to electromagnetic radiation to form a latent image, and B) simultaneously or sequentially, heating the exposed photothermographic material to develop the latent image into a visible image.

22. The method of claim 21 wherein said photothermographic material is imagewise exposed using electromagnetic radiation in the visible region.

23. The method of claim 21 wherein said photothermographic material is imagewise exposed using near-infrared or infrared radiation.

24. The method of claim 23 wherein said photothermographic material is imagewise exposed using an infrared emitting laser in a multilongitudinal mode.

25. The method of claim 21 wherein said photothermographic material support is transparent and said method further comprises:

C) positioning said exposed and heat-developed photothermographic material with a visible image therein between a source of imaging radiation and an imageable material that is sensitive to said imaging radiation, and D) exposing said imageable material to said imaging radiation through the visible image in said exposed and heat-developed photothermographic material to provide an image in said imageable material.

26. The method of claim 25 wherein said imageable material is a photopolymer, a diazo material, a photoresist, or a photosensitive printing plate.

27. A method for preparing a photothermographic emulsion comprising:

A) providing a photothermographic emulsion comprising a photocatalyst and a non-photosensitive source of reducible silver ions, B) positioning an organic solvent-soluble thiourea speed increasing compound represented by the following Structure I, or II, or III on or around said photocatalyst:

I

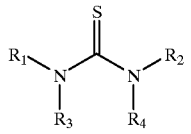

II

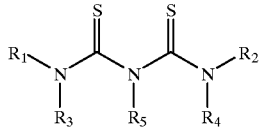

-continued

III

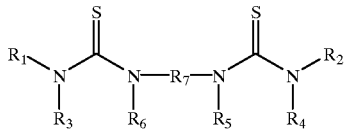

wherein:

in Structure I, $R_1$, $R_2$, $R_3$ and $R_4$ are independently alkyl, cycloalkyl, allyl, alkenyl, alkynyl, aryl or heterocyclic groups, or $R_1$ and $R_2$ taken together, $R_3$ and $R_4$ taken together, $R_1$ and $R_3$ taken together or $R_2$ and $R_4$ taken together, can form a 5- to to 7-membered heterocyclic ring, in Structure II, $R_1$, $R_2$, $R_3$, $R_4$ and $R_5$ are independently alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, in Structure III, $R_1$, $R_2$, $R_3$, $R_4$, $R_5$, and $R_6$ are independently alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, provided that said speed increasing compound represented by Structure I does not require a heat activation step at 30° C. or higher temperature for at least 5 minutes, has a pKa of at least 7, and is free of exocyclic carbon-carbon double bonds and nucleophilic groups, and C) when a speed increasing compound represented by Structure I is present, chemically sensitizing said photothermographic emulsion at a temperature below 30° C.

* * * * *